US008953989B2

(12) United States Patent
Funada et al.

(10) Patent No.: US 8,953,989 B2
(45) Date of Patent: Feb. 10, 2015

(54) DEVELOPING DEVICE AND IMAGE FORMING APPARATUS

(71) Applicant: Fuji Xerox Co., Ltd., Tokyo (JP)

(72) Inventors: Atsushi Funada, Kangaawa (JP); Nobumasa Furuya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 109 days.

(21) Appl. No.: 13/684,392

(22) Filed: Nov. 23, 2012

(65) Prior Publication Data

US 2013/0315635 A1 Nov. 28, 2013

(30) Foreign Application Priority Data

May 22, 2012 (JP) ..... 2012-116336

(51) Int. Cl.
*G03G 15/09* (2006.01)
*G03G 15/08* (2006.01)

(52) U.S. Cl.
CPC ..... *G03G 15/0921* (2013.01); *G03G 15/081* (2013.01); *G03G 2215/0648* (2013.01)
USPC ..... 399/269

(58) Field of Classification Search
CPC ..... G03G 15/0173; G03G 15/0163; G03G 15/0808; G03G 15/0812; G03G 15/0813; G03G 15/0872; G03G 2215/0106; G03G 2215/0177; G03G 2215/0634; G03G 2215/0636; G03G 15/0921
See application file for complete search history.

(56) References Cited

U.S. PATENT DOCUMENTS

| | | | | |
|---|---|---|---|---|
| 4,716,437 | A * | 12/1987 | MacLellan | 399/234 |
| 5,005,516 | A * | 4/1991 | Speer | 399/53 |
| 5,995,790 | A * | 11/1999 | Takeda | 399/274 |
| 6,330,414 | B1 * | 12/2001 | Takuma et al. | 399/267 |
| 2011/0229215 | A1 | 9/2011 | Hirota et al. | |

FOREIGN PATENT DOCUMENTS

| | | |
|---|---|---|
| JP | A-2006-047840 | 2/2006 |
| JP | A-2008-033020 | 2/2008 |
| JP | A-2011-191678 | 9/2011 |

* cited by examiner

*Primary Examiner* — Clayton E Laballe
*Assistant Examiner* — Victor Verbitsky
(74) *Attorney, Agent, or Firm* — Oliff PLC

(57) ABSTRACT

A developing device includes a first developing roller, a second developing roller, a layer regulation member, a pair of division magnetic poles that divide a developer which is held by the second developing roller after passing through the layer regulation member and transfer the developer to the first developing roller, and a transfer amount regulation member that has a plate shape, is provided in a developer transfer path formed by the pair of division magnetic poles between the first developing roller and the second developing roller so as to extend in an axial direction of the first and second developing rollers, and is provided with a slit which regulates the amount of developer passing therethrough.

8 Claims, 17 Drawing Sheets

DEVELOPING DEVICE AND IMAGE FORMING APPARATUS

CROSS-REFERENCE TO RELATED APPLICATIONS

This application is based on and claims priority under 35 USC 119 from Japanese Patent Application No. 2012-116336 filed May 22, 2012.

BACKGROUND (i) Technical Field

The present invention relates to a developing device and an image forming apparatus.

(ii) Related Art

Image forming apparatuses, such as printers, copying machines, and facsimile machines using image recording methods including an electrophotographic method and an electrostatic recording method, include a developing device that develops an electrostatic latent image formed on a latent image holder, such as a photoconductor, with a developer.

Among the developing devices, there is a developing device which includes plural (for example, two) developing rollers that hold a developer with magnetism using magnetic force, are rotated to a developing region facing a latent image holder, and transport the developer, thereby improving development efficiency. The developer with magnetism is, for example, a two-component developer including non-magnetic toner and magnetic carrier particles or a magnetic mono-component developer.

As this type of developing device, for example, the following developing devices have been known.

SUMMARY

According to an aspect of the invention, there is provided a developing device including: a first developing roller that has a cylindrical shape, is arranged with a predetermined gap from an outer circumferential surface of a rotating latent image holder, is rotated such that a moving direction of a portion approaching the latent image holder is opposite to that of the latent image holder, and holds and transports a developer with magnetic force; a second developing roller that has a cylindrical shape, is provided on a downstream side of the first developing roller in a rotational direction of the latent image holder, with a predetermined gap from the outer circumferential surface of the latent image holder and the first developing roller, is rotated such that a moving direction of a portion approaching the latent image holder is the same as that of the latent image holder, and holds and transports the developer with the magnetic force; a layer regulation member that is arranged with a predetermined gap from the second developing roller and regulates the height of a layer of the developer which is supplied and held by the outer circumferential surface of the second developing roller; a pair of division magnetic poles that have different polarities, are arranged in adjacent regions between the first and second developing rollers in an internal space of the first developing roller and an internal space of the second developing roller so as to face each other, without being rotated, divide the developer which is held by the second developing roller after passing through the layer regulation member, and transfer the developer to the first developing roller; and a transfer amount regulation member that has a plate shape, is provided in a developer transfer path formed by the pair of division magnetic poles between the first developing roller and the second developing roller so as to extend in an axial direction of the first and second developing rollers, and is provided with a slit which regulates the amount of developer passing therethrough.

BRIEF DESCRIPTION OF THE DRAWINGS

Exemplary embodiments of the present invention will be described in detail based on the following figures, wherein.

DETAILED DESCRIPTION

Hereinafter, exemplary embodiments of the invention (hereinafter, referred to as "exemplary embodiments") will be described with reference to the accompanying drawings.

First Exemplary Embodiment

Figure 1:
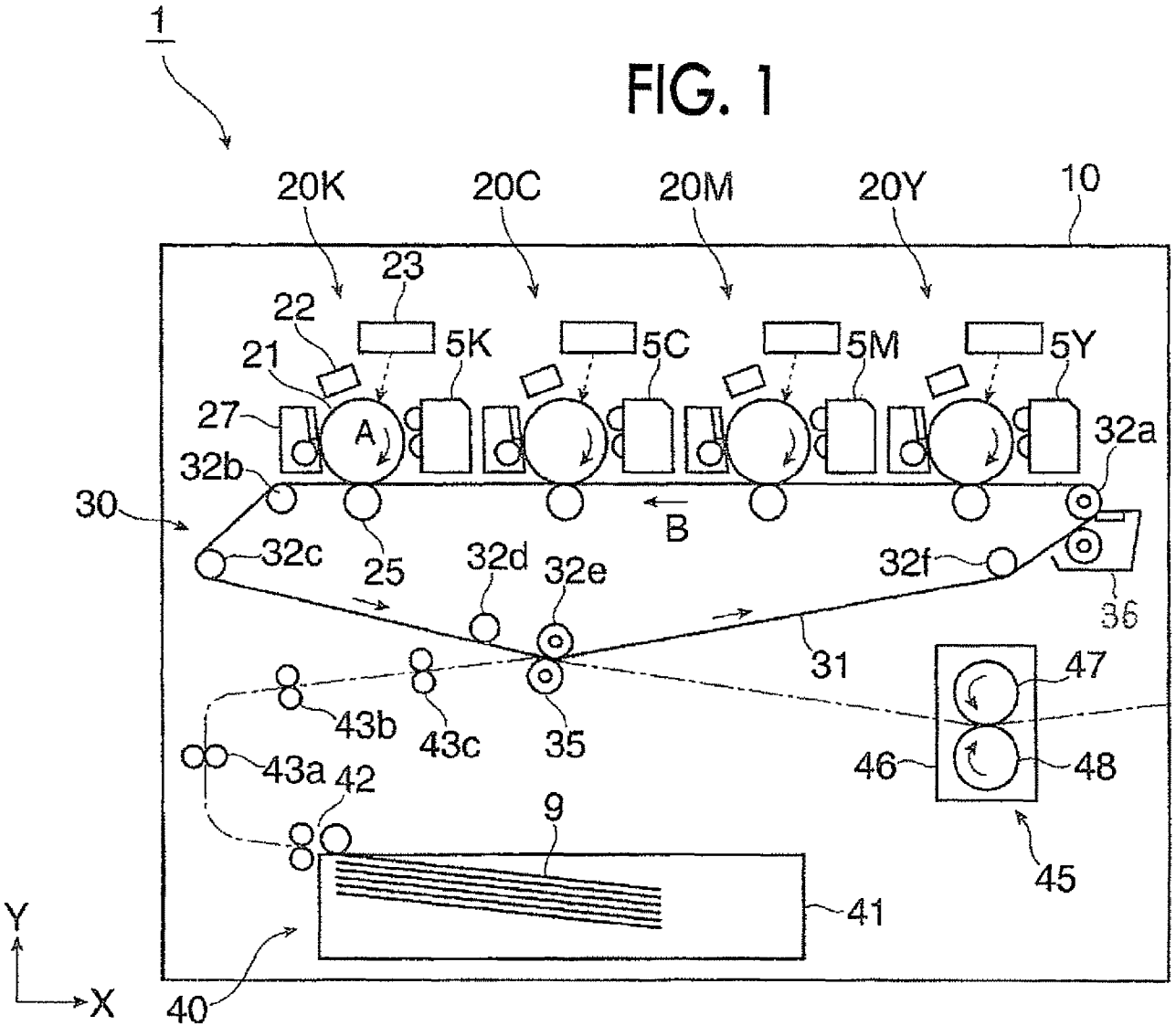
FIG. 1 is a diagram illustrating an image forming apparatus using a developing device according to a first exemplary embodiment.
Figure 2:
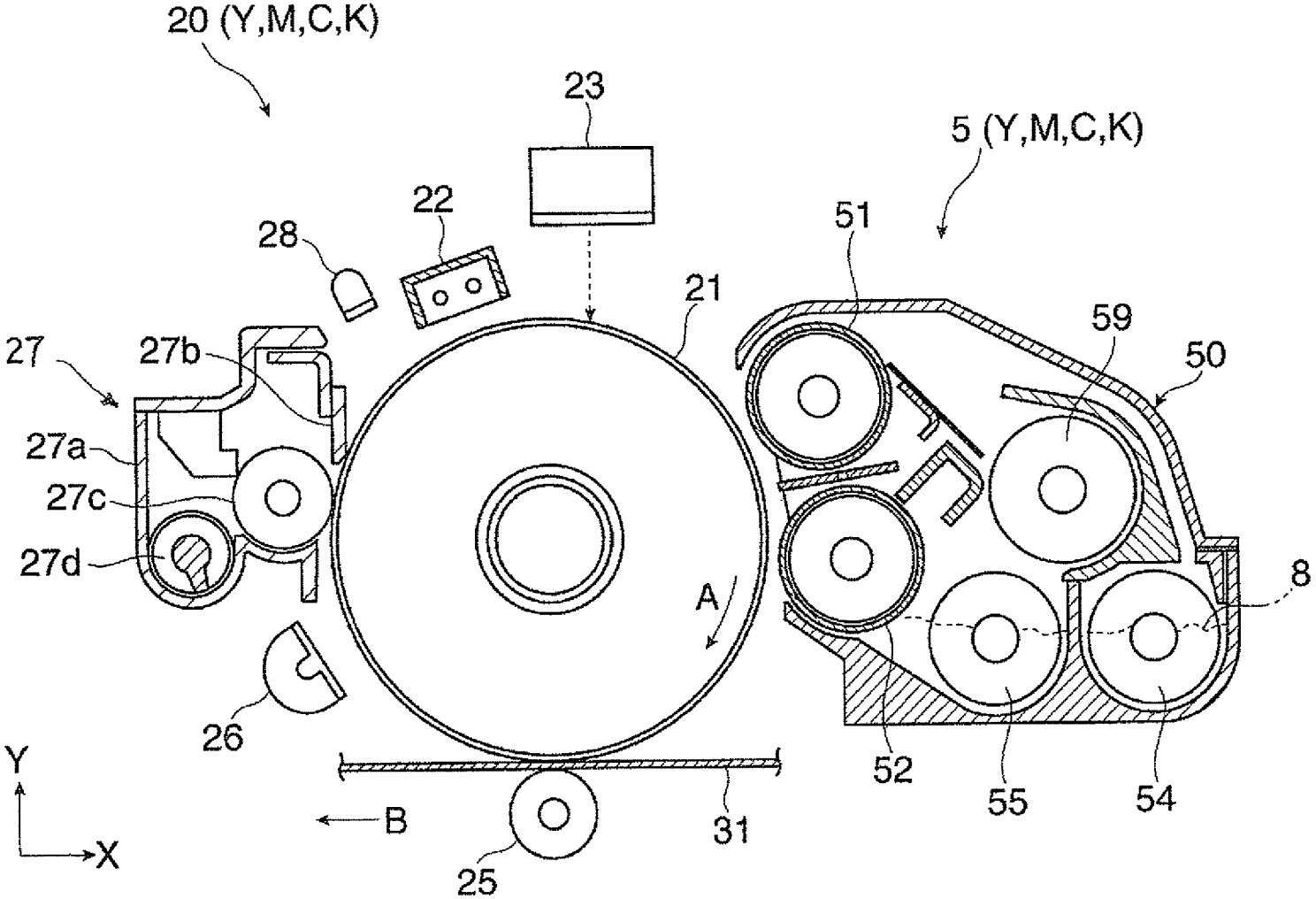
FIG. 2 is a partial cross-sectional view illustrating a main portion (for example, an image forming device) of the image forming apparatus shown in FIG. 1.
Figure 3:
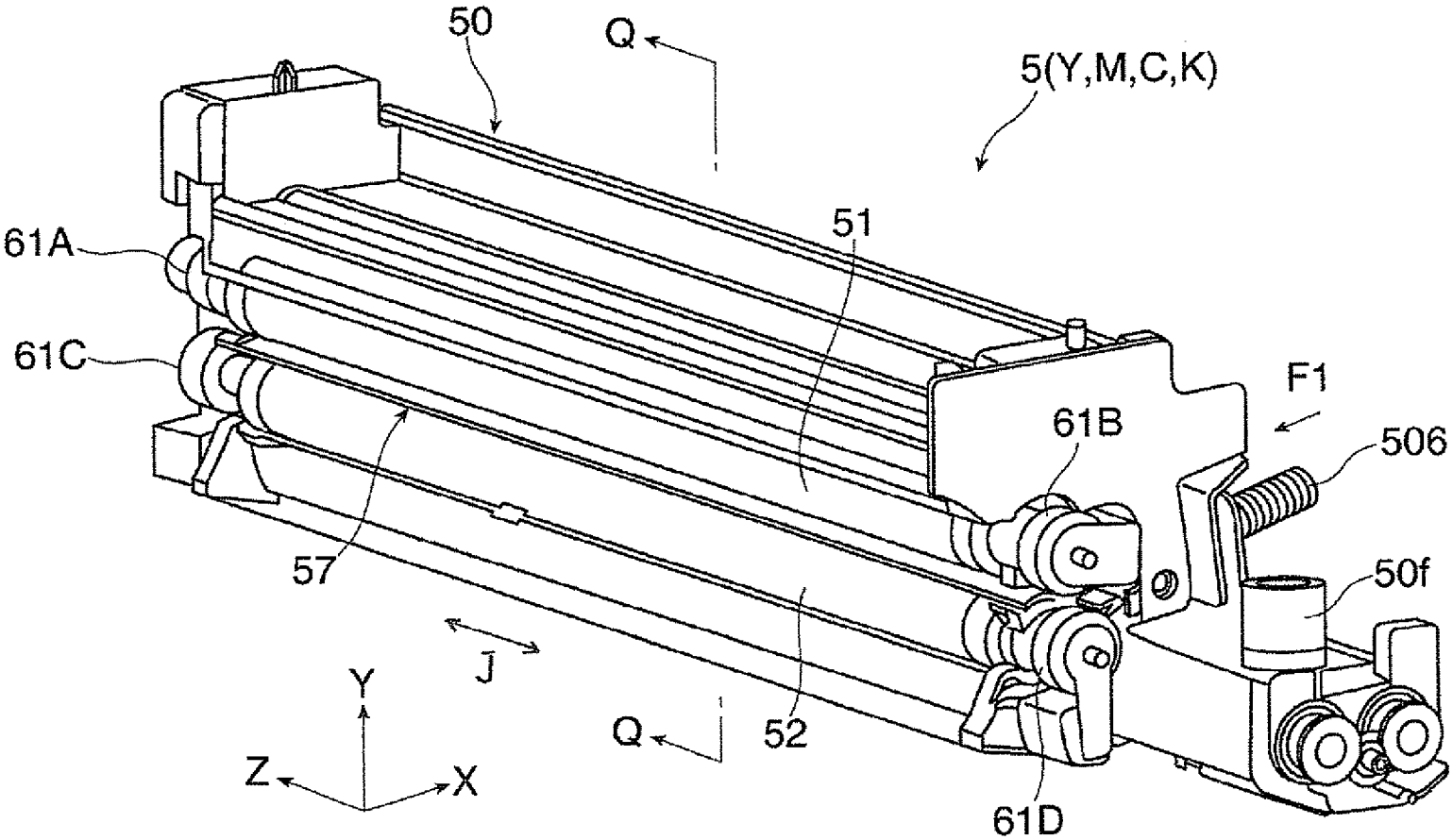
FIG. 3 is a schematic perspective view illustrating the developing device used in the image forming apparatus shown in FIG. 1.

FIGS. 1 to 3 show an image forming apparatus using a developing device according to the first exemplary embodiment. FIG. 1 shows the outline of the image forming apparatus, FIG. 2 shows the entire developing device, and FIG. 3 shows a main portion of the developing device.

Overall Structure of Image Forming Apparatus

An image forming apparatus 1 is, for example, a color printer. The image forming apparatus 1 includes the following devices provided in the internal space of a housing 10: plural image forming devices 20 that form toner images to be developed with toner (for example, colored fine particles) forming a developer; an intermediate transfer device 30 that holds the toner images formed by each image forming device 20 and finally secondarily transfers the toner images onto a recording sheet 9 which is an example of a recording material; a sheet feeding device 40 that stores predetermined recording sheets 9 to be supplied to a secondary transfer unit of the intermediate transfer device 30 and transports the recording sheets 9; and a fixing device 45 through which the recording sheet 9 having the toner images transferred thereto by the intermediate transfer device 30 passes and which fixes the toner images. In the housing 10, a supporting structure or an external portion is formed by a supporting member or an external cover or the like. In FIG. 1, a one-dot chain line indicates a main transport path through which the recording sheet 9 is transported in the housing 10.

The image forming devices 20 include four image forming devices 20Y, 20M, 20C, and 20K that form four color toner images, such as yellow (Y), magenta (M), cyan (C) and black (K) toner images, respectively. The four image forming devices 20 (Y, M, C, and K) are arranged in series to each other in the internal space of the housing 10. The image forming devices 20 (Y, M, C, and K) have substantially the same structure except that they use different kinds of developers, as described below.

As shown in FIG. 1 or FIG. 2, each of the image forming devices 20 (Y, M, C, and K) includes a rotating photosensitive drum 21 and the following main devices are arranged around the photosensitive drum 21. The main devices include a charging device 22 that charges the outer circumferential surface (image holding surface) of the photosensitive drum 21 on which an image may be formed with a predetermined potential, an exposure device 23 that emits light to the charged outer circumferential surface of the photosensitive drum 21 on the basis of image information (signal) to form electrostatic latent images (for each color) having a potential difference therebetween, a developing device 5 (Y, M, C, or K) that develops the electrostatic latent image with a corresponding color toner (Y, M, C, or K), which is a developer, to form a toner image, a primary transfer device 25 that transfers the toner image onto (the intermediate transfer belt of) the intermediate transfer device 30, a charging device 26 before cleaning that charges an attached material, such as toner, that remains on the outer circumferential surface of the photosensitive drum 21 after primary transfer, a drum cleaning device 27 that removes the charged attached material and cleans the photosensitive drum 21, and a charge remover 28 that neutralizes the image holding surface after the photosensitive drum 21 is cleaned.

In the photosensitive drum 21, the image holding surface including a photoconductive layer (photosensitive layer) made of a photosensitive material is formed on the circumferential surface of a cylindrical or columnar base which is grounded. The photosensitive drum 21 is supported such that it is driven by a rotating device (not shown) and is rotated in the direction of an arrow A. The charging device 22 is a non-contact-type charging device, such as a corona discharger that is arranged without contacting the photosensitive drum 21, or a contact-type charging device using, for example, a charging roller that is supplied with a charging voltage and is arranged while contacting the photosensitive drum 21. When the developing device 5 performs reversal development, a voltage or a current with the same polarity as the charging polarity of the toner supplied from the developing device is supplied as the charging voltage.

The exposure device 23 emits light (dotted line with an arrow) corresponding to the image information input to the image forming apparatus 1 to the image holding surface of the charged photosensitive drum 21 to form an electrostatic latent image. An image processing device performs necessary image processing for information about a print target image input to the image forming apparatus 1 and the image signal of each of the processed color components is transmitted to the exposure device 23. The developing devices 5 (Y, M, C, and K) use, for example, a two-component developer 8 including the four color non-magnetic toners and magnetic carrier particles. In particular, as shown in FIG. 2 or FIG. 3, the developing device 5 includes two developing rollers 51 and 52. The developing device 5 will be described in detail below.

The primary transfer device 25 is a contact-type transfer device including a primary transfer roller that contacts the outer circumferential surface of the photosensitive drum 21, is rotated, and is supplied with a primary transfer voltage. For example, a DC voltage with a polarity opposite to the charging polarity of toner is supplied as the primary transfer voltage. The primary transfer device 25 may form the intermediate transfer device 30. As shown in FIG. 2, the drum cleaning device 27 includes a container-shaped housing 27*a* that is partially opened, a cleaning plate 27*b* that is provided so as to contact the outer circumferential surface of the photosensitive drum 21 after primary transfer with predetermined pressure and removes the attached material, such as the remaining toner, a rotating brush roller 27*c* that contacts the outer circumferential surface of the photosensitive drum 21 on the upstream side of the cleaning plate 27*b* in the rotational direction of the photosensitive drum 21, is rotated, and cleans the photosensitive drum 21, and a transmitting member 27*d*, such as a screw auger that is driven so as to collect the attached material, such as the toner removed by the cleaning plate 27*b*, and transmit the collected material to a collection system (not shown). A plate-shaped member made of, for example, rubber is used as the cleaning plate 27*b*.

As shown in FIG. 1, the intermediate transfer device 30 is arranged so as to be disposed below each image forming device 20 (Y, M, C, or K). The intermediate transfer device 30 mainly includes an intermediate transfer belt 31 that is rotated in the direction of an arrow B while passing through a primary transfer position between the photosensitive drum 21 and the primary transfer device 25 (primary transfer roller), plural supporting rollers 32*a* to 32*f* that hold the intermediate transfer belt 31 in a desired state with their inner surfaces and rotatably support the intermediate transfer belt 31, a secondary transfer device 35 that contacts the outer circumferential surface (image holding surface) of the intermediate transfer belt 31 supported by the supporting roller 32*e* with predetermined pressure and is rotated, and a belt cleaning device 36 that removes an attached material, such as toner or paper powder remaining on the outer circumferential surface of the intermediate transfer belt 31 after passing through the secondary transfer device 35, and cleans the intermediate transfer belt.

For example, an endless belt is used which is formed by dispersing resin particles made of polytetrafluoroethylene (PTFE) to a belt base, which is formed by dispersing a resistance adjusting agent, such as carbon black, to a synthetic resin, such as polyimide resin or polyamide resin, in order to separate the toner image, is used as the intermediate transfer belt 31. In addition, the supporting roller 32*a* is a driving roller, the supporting rollers 32*b*, 32*d*, and 32*f* are driven rollers that hold the traveling position of the belt, the supporting roller 32*c* is a tension applying roller, and the supporting roller 32*e* is a backup roller for secondary transfer.

The secondary transfer device 35 is a secondary transfer roller that contacts the outer circumferential surface of the intermediate transfer belt 31 supported by the backup roller 32*e* with predetermined pressure and is supplied with a secondary transfer voltage. For example, a DC voltage with the same polarity (or a polarity opposite to) as the charging polarity of toner is supplied as the secondary transfer voltage. The belt cleaning device 36 includes a cleaning plate that is arranged so as to contact the outer circumferential surface of the intermediate transfer belt 31 after passing through the secondary transfer device 35 with predetermined pressure and removes an attached material, such as the remaining toner, and a rotating brush that contacts the outer circumferential surface of the intermediate transfer belt 31 on the upstream side of the cleaning plate in the rotational direction B of the belt and cleans the belt. For example, a plate-shaped member made of rubber is used as the cleaning plate.

The sheet feeding device 40 is arranged so as to be disposed below the intermediate transfer device 30. The sheet feeding device 40 mainly includes a single (or plural) sheet storage unit 41 that is attached so as to be drawn to the front side (the side that the user faces when using the apparatus) of the housing 10 and stores the desired size and type of the recording sheets 9 and a transport device 42 that transports the recording sheets 9 one by one from the sheet storage unit 41. The recording sheet 9 is transported from the sheet feeding device 40 to the secondary transfer position (between the intermediate transfer belt 31 and the secondary transfer device 35) of the intermediate transfer device 30 through a transport path formed by plural sheet transporting roller pairs 43*a*, 43*b*, 43*c*, . . . and a transport guide member. In addition, a transport device (not shown) that transports the recording sheet 9 after secondary transfer to the fixing device 45 is provided between the secondary transfer device 35 and the fixing device 45.

In the fixing device 45, a housing 46 includes a heated rotating body 47 that is rotated in the direction of an arrow and is heated by a heating unit such that the surface temperature thereof is maintained at a predetermined value and a rotating body 48 for pressure that contacts the heated rotating body 47 substantially along the axial direction with predetermined pressure and is driven. The recording sheet 9 to which the toner image has been fixed by the fixing device 45 and on which an image has been formed is transported to a discharge unit (not shown) which is provided in, for example, the housing 10 through a discharge and transport path formed by plural transport roller pairs and a transport guide member and is then stored therein.

Operation of Image Forming Apparatus

Next, the basic image forming operation (print) of the image forming apparatus 1 will be described. Here, the pattern of the image forming operation of forming four color (Y, M, C, and K) toner images using all of the four image forming devices 20 (Y, M, C, and K) and combining the four color toner images to form a full color image will be described as a representative example.

When a request to perform the image forming operation (print) is input to the image forming apparatus 1, in the four image forming devices 20 (Y, M, C, and K), first, each photosensitive drum 21 is rotated in the direction of the arrow A and each charging device 22 charges the image holding surface of each photosensitive drum 21 with a predetermined polarity (in this exemplary embodiment, a negative polarity) and potential. Then, the exposure device 23 emits light to the surface of the charged photosensitive drum 21 to expose the surface on the basis of image data decomposed into each color component (Y, M, C, or K) which is transmitted from the image processing device, thereby forming color electrostatic latent images formed by a predetermined potential difference.

Then, each developing device 5 (Y, M, C, or K) supplies a corresponding color (Y, M, C, or K) toner which is charged with a predetermined polarity (negative polarity) to the color electrostatic latent image formed on the photosensitive drum 21 from the developing rollers 51 and 52 and electrostatically attaches the color toner. The color electrostatic latent images formed on each photosensitive drum 21 by the development process are developed with the corresponding color toners and four visible color (Y, M, C, and K) toner images are obtained.

Then, the primary transfer device 25 sequentially and primarily transfers the color toner images formed on the photosensitive drums 21 of the image forming devices 20 (Y, M, C, and K) onto the intermediate transfer belt 31 which is rotated in the direction of the arrow B in the intermediate transfer device 30 so as to overlap each other. The charging device 26 before cleaning recharges an attached material, such as toner, remaining on the outer circumferential surface of the photosensitive drum 21 in each image forming device 20 after the primary transfer, and the drum cleaning device 27 removes the attached material to clean the photosensitive drum 21. Then, the charge remover 28 neutralizes the cleaned outer circumferential surface.

Then, the intermediate transfer device 30 transports the toner images primarily transferred onto the intermediate transfer belt 31 to the secondary transfer position and collectively secondarily transfers the toner images on the intermediate transfer belt 31 onto the recording sheet 9 which is fed and transported from the sheet feeding device 40 at the secondary transfer position. The belt cleaning device 36 removes the attached material, such as toner, remaining on the outer circumferential surface of the intermediate transfer belt 31 after the secondary transfer and cleans the intermediate transfer belt 31.

Finally, the recording sheet 9 having the toner images secondarily transferred thereto is separated from the intermediate transfer belt 31 and is then transported to the fixing device 45. Then, a necessary fixing process (heat and pressure) is performed on the recording sheet 9 to fix non-fixed toner images to the recording sheet 9. When only a one-side image forming operation is performed, the recording sheet 9 subjected to the fixing process is discharged to, for example, a discharge and storage unit (not shown) provided in the housing 10 and is then stored therein.

In this way, the recording sheet 9 on which a full color image obtained by combining four color toner images is formed is output to the outside of the housing 10.

Structure of Developing Device

Next, the developing device 5 will be described in detail.

Figure 4:
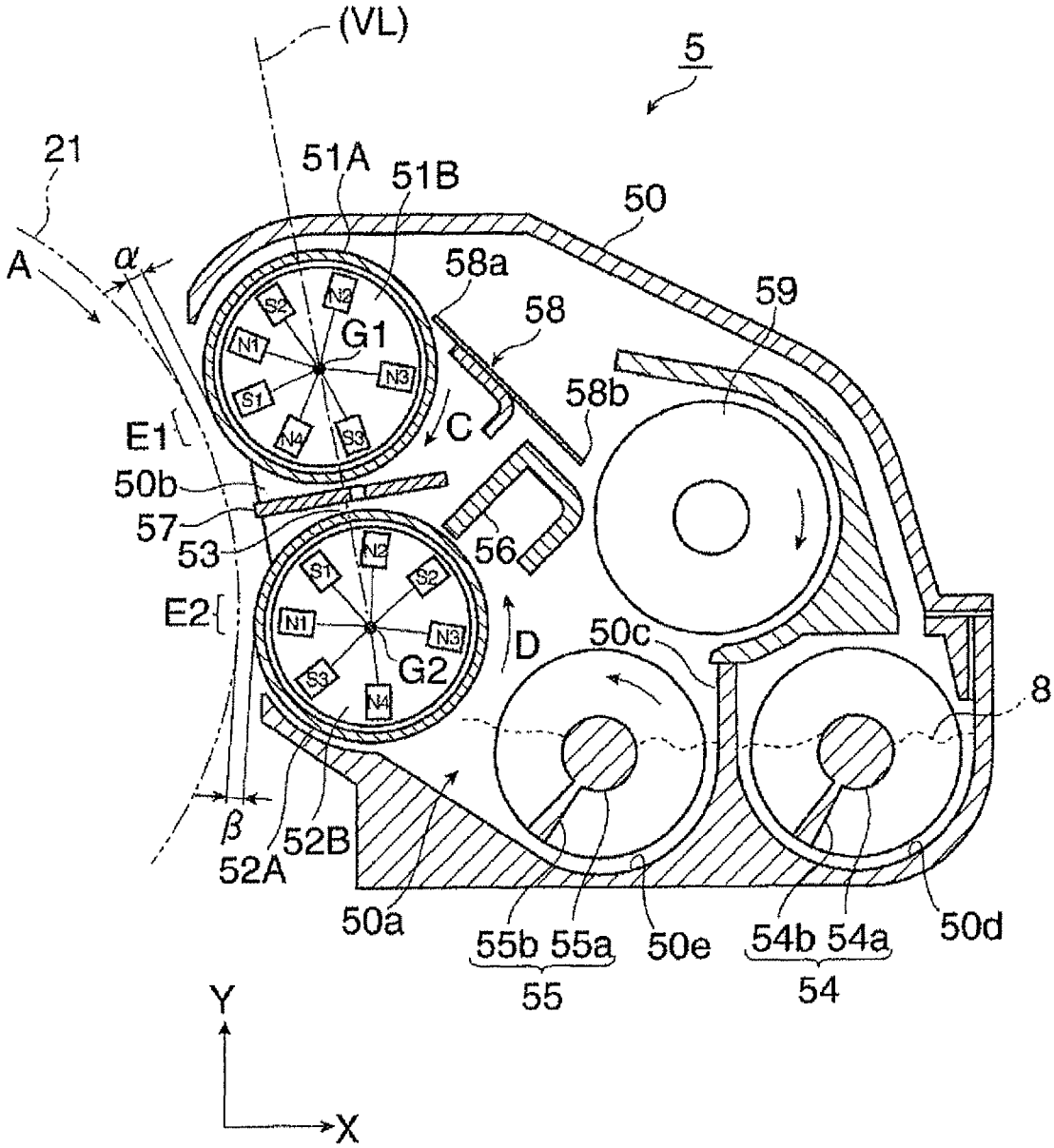
FIG. 4 is a schematic cross-sectional view illustrating the developing device taken along the line Q-Q of FIG. 3.

As shown in FIGS. 2 to 4, the developing device 5 includes a housing 50 including a storage unit 50*a* that stores the two-component developer 8 and a rectangular opening 50*b* that is formed at a position facing the photosensitive drum 21. The housing 50 has a long container shape with a length more than that of the photosensitive drum 21 in the axial direction. The storage unit 50*a* includes transport paths (grooves) 50*d* and 50*e* which are substantially parallel to each other and are partitioned by a central partition wall 50*c* formed in the longitudinal direction of the long container shape. The two transport paths 50*d* and 50*e* are connected to each other at both ends to form a circulation-type transport path. The two-component developer 8 is stored in the transport paths 50*d* and 50*e* of the storage unit 50*a*. In FIG. 3, reference numeral 50*f* indicates a cylindrical receiving portion that receives the developer supplied from a developer supply device (not shown).

As shown in FIG. 4, the developing device 5 includes the following components provided in the housing 50: two developing rollers 51 and 52 (a first developing roller 51 and a second developing roller 52) that transport the two-component developer 8 to two developing regions E1 and E2 facing the photosensitive drum 21 while maintaining magnetic force; two screw augers 54 and 55 that serve as stir and transport members, stir the two-component developer 8 stored in the storage room 50*a* and transport the two-component developer 8; a layer regulation plate 56 that regulates the passage of the two-component developer 8 supplied from the screw auger 55 to the second developing roller 52 and regulates the height of the layer (transport amount); a transfer amount regulation plate 57 that regulates the amount of developer when a portion of the developer 8 transported from the second developing roller 52 is transferred to the first developing roller 51; a collection guide plate 58 that guides the developer 8 separated from the first developing roller 51 so as to return to the storage unit 50*a;* and a storage paddle 59 that temporarily stores a portion of the developer 8 moved from the collection guide plate 58 to the storage unit 50*a*.

The first developing roller 51 and the second developing roller 52 are provided so as to be rotated in predetermined directions C and D while being partially exposed from the opening 50*b* of the housing 50. The two developing rollers 51 and 52 are arranged with a predetermined gap γ therebetween (FIG. 6) in the rotational direction A of the photosensitive drum 21 and a space between adjacent portions of the developing rollers 51 and 52 is formed as a narrowest gap portion 53.

Among the components, the first developing roller 51 includes a cylindrical sleeve 51A that is supported so as to be rotated in the direction of an arrow C, with a predetermined gap α from the first developing region E1 of the outer circumferential surface of the photosensitive drum 21, and a magnet roller 51B that is provided so as to be fixed to the inside of the sleeve 51A. The rotational direction C of the sleeve 51A is set such that the moving direction in the first developing region E1 of the photosensitive drum 21 is opposite (reverse) to the rotational (moving) direction A of the photosensitive drum 21.

The second developing roller 52 includes a cylindrical sleeve 52A that is supported to be rotated in the direction of an arrow D, with a predetermined gap β from the second developing region E2 which is on the downstream side of the first developing region E1 in the outer circumferential surface of the photosensitive drum 21, and a magnet roller 52B that is provided so as to be fixed to the inside of the sleeve 52A. The rotational direction D of the sleeve 52A is set such that the moving direction in the second developing region E2 of the photosensitive drum 21 is the same as the rotational direction A of the photosensitive drum 21.

Each of the sleeves 51A and 52A is made of a non-magnetic material (for example, stainless steel or aluminum) and has a shape which includes at least a cylindrical portion having substantially the same width (length) as an effective image forming region in the rotation axis direction of the photosensitive drum 21. In addition, shafts are formed at both ends of the sleeves 51A and 52A and are rotatably supported by a side supporting portion 50 of the housing 50. A developing voltage for forming a developing electric field between the developing device and the photosensitive drum 21 is applied from a power supply device (not shown) to the sleeves 51A and 52A. For example, a DC voltage obtained by overlapping AC components is applied as the developing voltage.

Each of the magnet rollers 51B and 52B includes plural magnetic poles (the S-pole and the N-pole) which generate magnetic force (magnetic field lines) such that magnetic carriers of the developer 8 are held by the outer circumferential surfaces of the sleeves 51A and 52A while forming a magnetic brush thereon. For example, the magnet rollers 51B and 52B are attached, with both ends fixed to the side surface of the housing 50 through the internal spaces of the shafts of the developing sleeves 51A and 52A. The plural magnetic poles extend in the axial direction J (FIG. 3) of the sleeves 51A and 52A and are arranged at predetermined positions, with a gap therebetween in the circumferential direction (rotational direction) of the sleeves 51A and 52A.

In the first exemplary embodiment, seven magnetic poles S3, N4, S1, N1, S2, N2, and N3 are arranged in the magnet roller 51B of the first developing roller 51. Among them, the magnetic pole S3 is a division pole that attracts the developer 8 which has been divided from the second developing roller 52 and then transported to the first developing roller 51 using magnetic force. The magnetic pole S1 is a developing pole that brings the developer 8 in a large magnetic brush (chain) state into contact with the outer circumferential surface of the photosensitive drum 21 in the first developing region E1 for development. The magnetic pole N4 and the magnetic pole N1 are transport assistance poles that assist the transport of the developer 8 in the upstream and downstream regions arranged before and after the developing pole S1 in the rotational direction C of the sleeve 51A. The magnetic pole S2 is a transport pole that holds the developer 8 passing through the developing region E1 and transports the developer 8. The magnetic pole N2 and the magnetic pole N3 are pickoff (peel-off) poles that generate a repulsive magnetic field to peel the developer 8 from the sleeve 51A.

Seven magnetic poles N3, S2, N2, S1, N1, S3, and N4 are provided in the magnet roller 52B of the second developing roller 52. Among them, the magnetic pole N3 is a pickup pole that attracts the developer 8 supplied from the screw auger 55 to the sleeve 52A and the magnetic pole S2 is a layer regulation assistance pole that assists the layer regulation of the layer regulation plate 56. The magnetic pole N2 forms a pair of division poles together with the division pole S3 of the first developing roller 51 and generates a function of dividing a portion of the developer 8 which has passed through the layer regulation plate 56 and then held by the second developing roller 52 and transferring the developer 8 to the first developing roller 51. The magnetic pole N1 is a developing pole that brings the developer 8 in a large magnetic brush state into contact with the outer circumferential surface of the photosensitive drum 21 in the second developing region E2 for development. The magnetic pole S1 and the magnetic pole S3 are transport assistance poles that assist the transport of the developer 8 in the upstream and downstream regions arranged before and after the developing pole N1 in the rotational direction D of the sleeve 52A. The magnetic pole N4 and the magnetic pole N3 are pickoff poles that generate a repulsive magnetic field to separate the developer 8 from the sleeve 52A.

In the developing device 5, for example, as shown in FIG. 4, the division pole S3 of the first developing roller 51 and the division pole N2 of the second developing roller 52 are arranged in a region which is opposite to the region in which the photosensitive drum 21 is provided, using a virtual line (VL) connecting the center position P1 of the magnet roller 51B corresponding to the rotation center of the first developing roller 51 and the center position P2 of the magnet roller 52B corresponding to the rotation center of the second developing roller 52 as a boundary. Specifically, the division pole S3 and the division pole N2 are arranged such that the center angle with respect to the virtual line (VL) connecting the center positions (P1 and P2) of the developing rollers 51 and 52 is in the range of, for example, 10° to 30°.

The screw augers 54 and 55 include rotating shafts 54*a* and 55*a* and helical transport blades 54*b* and 55*b* which are formed on the circumferential surfaces of the rotating shafts 54*a* and 55*a*. The screw augers 54 and 55 are rotatably provided in the two transport paths 50*d* and 50*e* in the storage unit 50*a* of the housing 50 and are rotated in a direction in which each developer 8 in the transport paths is moved in a predetermined transport direction. In addition, power for rotating the sleeves 51A and 52A of the developing rollers 51 and 52 is branched by a power transmission mechanism, such as a gear, and a portion of the power is transmitted to the screw augers 54 and 55 such that the screw augers 54 and 55 are rotated. The screw auger 55 arranged close to the second developing roller 52 supplies a portion of the transported developer 8 to the second developing roller 52.

A main portion of the layer regulation plate 56 is a plate that has a rectangular shape with a length (long side) equal to or more than the length of the sleeve 52A of the second developing roller 52 in the axial direction J. The layer regulation plate 56 is made of a non-magnetic material (for example, stainless steel). The layer regulation plate 56 is attached to the housing 50 such that one end (lower long side) thereof in the longitudinal direction faces the outer circumferential surface of the sleeve 52A, with a predetermined gap (layer regulation gap) therebetween and extends in the axial direction J of the sleeve 52A. The transfer amount regulation plate 57 will be described below.

The collection guide plate 58 is a plate with a surface that receives the developer peeling off from the first developing roller 51 and smoothly drops the developer so as to return to the storage room 50*a*. The collection guide plate 58 includes an upper end 58*a* that is disposed between the magnetic pole N2 and the magnetic pole N3, which are the pickoff poles of the first developing roller 51, and faces the outer circumferential surface of the sleeve 52A with a predetermined gap therebetween and a lower end 58*b* that extends from the upper end 58*a* to the lower side and is finally disposed above the screw auger 55.

The storage paddle 59 includes a blade portion in which a container-shaped portion which temporarily captures the developer 8 is formed around the rotating shaft. The storage paddle 59 is disposed substantially between the collection guide plate 58 and the screw auger 55 and is rotated in the direction of an arrow.

Next, the basic operation of the developing device 5 will be described.

Figure 5:
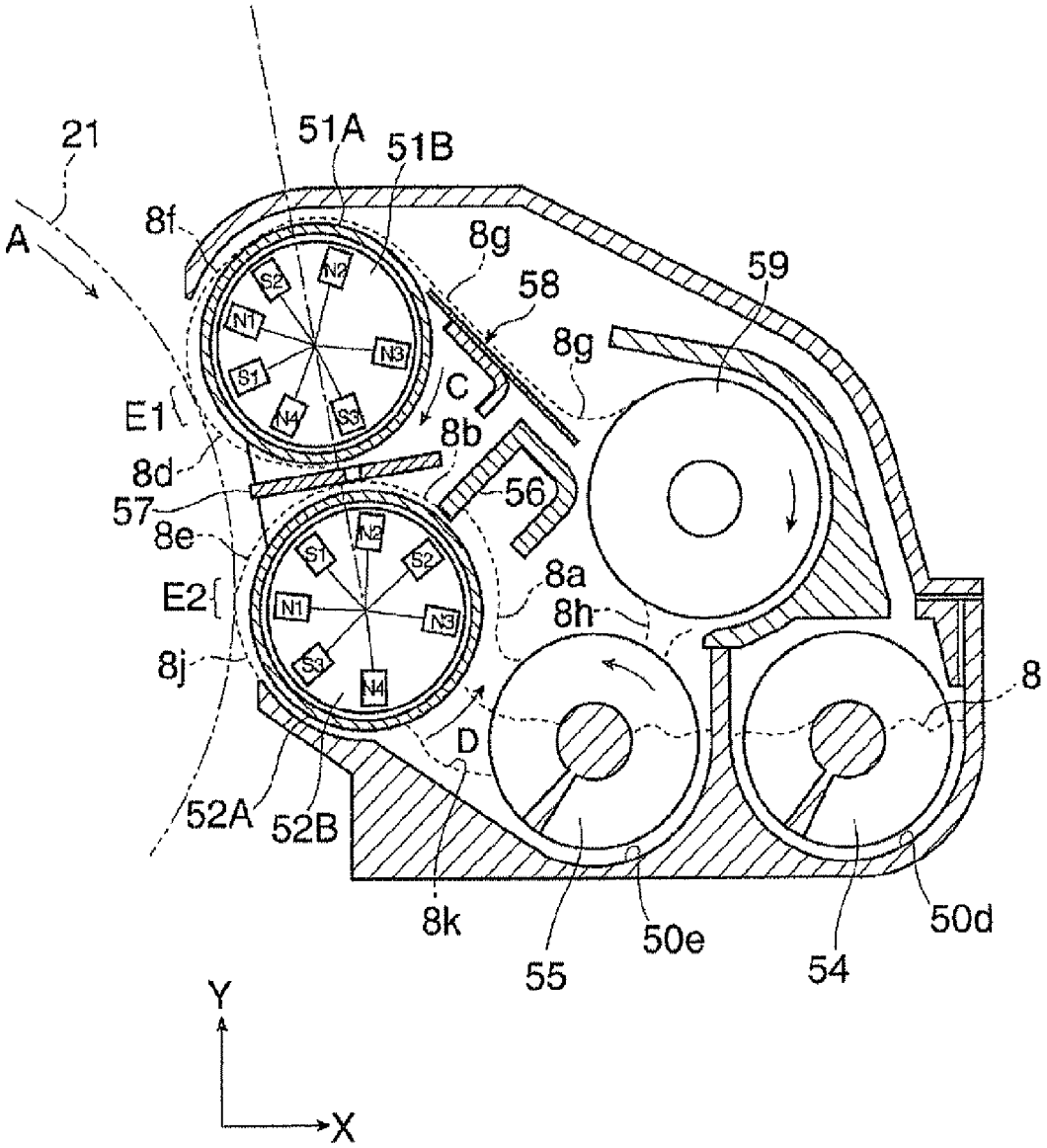
FIG. 5 is a cross-sectional view illustrating the basic operation of the developing device shown in FIG. 3.

First, during the image forming operation of the image forming apparatus 1, as shown in FIG. 5, in the developing device 5, the sleeves 51A and 52A of the two developing rollers 51 and 52, the screw augers 54 and 55, and the storage paddle 59 start to be rotated and the developing voltage is applied to each of the sleeves 51A and 52A.

Then, the two-component developer 8 stored in the storage unit 50*a* of the housing 50 is transported in the two transport paths 50*d* and 50*e* in the storage unit 50*a* in each direction while being stirred by the rotating augers 54 and 55. In this way, the two-component developer 8 is transported while being circulated as a whole. At that time, the non-magnetic toner of the two-component developer 8 is sufficiently mixed with magnetic carrier particles, is frictionally charged, and is electrostatically attached to the surface of the carrier.

Then, a portion 8*a* of the two-component developer 8 transported by the screw auger 55 which is arranged close to the second developing roller 52 is attracted to the outer circumferential surface of the sleeve 52A of the second developing roller 52 by magnetic force and is held thereon. That is, the magnetic force (magnetic field lines) generated from the magnetic pole N3 of the magnet roller 52B is applied to the outer circumferential surface of the rotating sleeve 52A and the portion 8*a* is held and supplied while forming a magnetic brush in a chain shape of magnetic carriers having toner attached thereto.

Then, while the two-component developer 8*a* held by the second developing roller 52 is being transported with the rotation of the sleeve 52*a*, a portion thereof is blocked by the layer regulation plate 56 and the other portion passes through the layer regulation plate 56. That is, the developer 8*a* which has reached the layer regulation plate 56 receives the magnetic force of the layer regulation assistance magnetic pole S2, forms a magnetic brush, and is in a rising state. A portion of the developer is blocked by the layer regulation plate 56 and most of the developer returns to the storage unit 50*a*. When the remaining developer 8*b* passes through a gap between the sleeve 52A and the layer regulation plate 56, the passage of the developer 8*b* is regulated and the developer 8*b* has a substantially constant height (transport amount).

Then, after passing through the layer regulation plate 56, the developer 8*b* reaches the narrowest gap portion 53 between the second developing roller 52 and the first developing roller 51. In the narrowest gap portion 53, a transfer path (8*c*) is formed through which some carrier particles of the developer 8*a* are arranged in a chain shape so as to connect the two developing rollers 51 and 52 and are moved together with toner particles from the second developing roller 52 to the first developing roller 51 by the magnetic force formed between the division poles N2 and S3 of (the magnet rollers 51B and 52B of) the two developing rollers 51 and 52 which are arranged so as to face each other. Therefore, when the developer 8*b* passes through a position close to the narrowest gap portion 53, a portion of the developer is separated from the first developing roller 51, passes through the transfer path, and is transported to the first developing roller 51. In this way, the developer 8*b* which has passed through the layer regulation plate 56 and then held by the second developing roller 52 is distributed and divided at a predetermined ratio to the second developing roller 52 and the first developing roller 51 (developers 8*c* and 8*d*).

In this case, the developer 8*d* distributed to the first developing roller 51 is transported by the sleeve 51A which is rotated in the direction of the arrow C. When passing through the first developing region E1 disposed on the upstream side of the photosensitive drum 21 in the rotational direction A, the developer 8*d* receives the magnetic force of the developing magnetic pole S1 and is subjected to the action of the developing electric field generated by the developing voltage. Then, toner in the magnetic brush of the developer 8*d* reciprocates between the first developing roller 51 and the photosensitive drum 21, is attached to a latent image passing through the first developing region E1, and develops the latent image.

Finally, after passing through the first developing region E1, a developer 8*f* is transported while being held by the outer circumferential surface of the first developing roller 51 by the magnetic force generated by the transport assistance pole N1 and the transport pole 52 and is separated from the outer circumferential surface of the sleeve 51A by the repulsive magnetic force formed between the magnetic pole N2 and the magnetic pole N3, which are pickoff poles. In this case, the separated developer 8*g* is guided to the collection guide plate 58 and falls to the storage unit 50*a*. While the developer 8*g* is falling, a portion of the developer 8*g* is temporarily captured and stored by the storage paddle 59. Finally, the portion of the developer 8*g* falls as a developer 8*h* from the storage paddle 59 and returns to the storage unit 50*a*.

The developer 8*e* distributed to the second developing roller 52 is transported by the sleeve 52A which is rotated in the direction of the arrow D. When passing through the second developing region E2 disposed on the downstream side of the photosensitive drum 21 in the rotational direction A, the developer 8*e* receives the magnetic force of the developing magnetic pole N1 and is subjected to the action of the developing electric field generated by the developing voltage. Then, toner in the magnetic brush of the developer 8*e* reciprocates between the second developing roller 52 and the photosensitive drum 21, is attached to the latent image passing through the second developing region E2, and develops the latent image.

After passing through the second developing region E2, a developer 8*j* is transported while being held by the outer circumferential surface of the second developing roller 52 by the magnetic force generated by the transport assistance pole S3 and the transport pole N4 and is separated from the outer circumferential surface of the sleeve 52A by the repulsive magnetic force formed between the magnetic pole N4 and the magnetic pole N3, which are pickoff poles. Then, the developer free-falls as a developer 8*k* and returns to the storage unit 50*a*.

Detailed Structure of Developing Device

Figure 6:
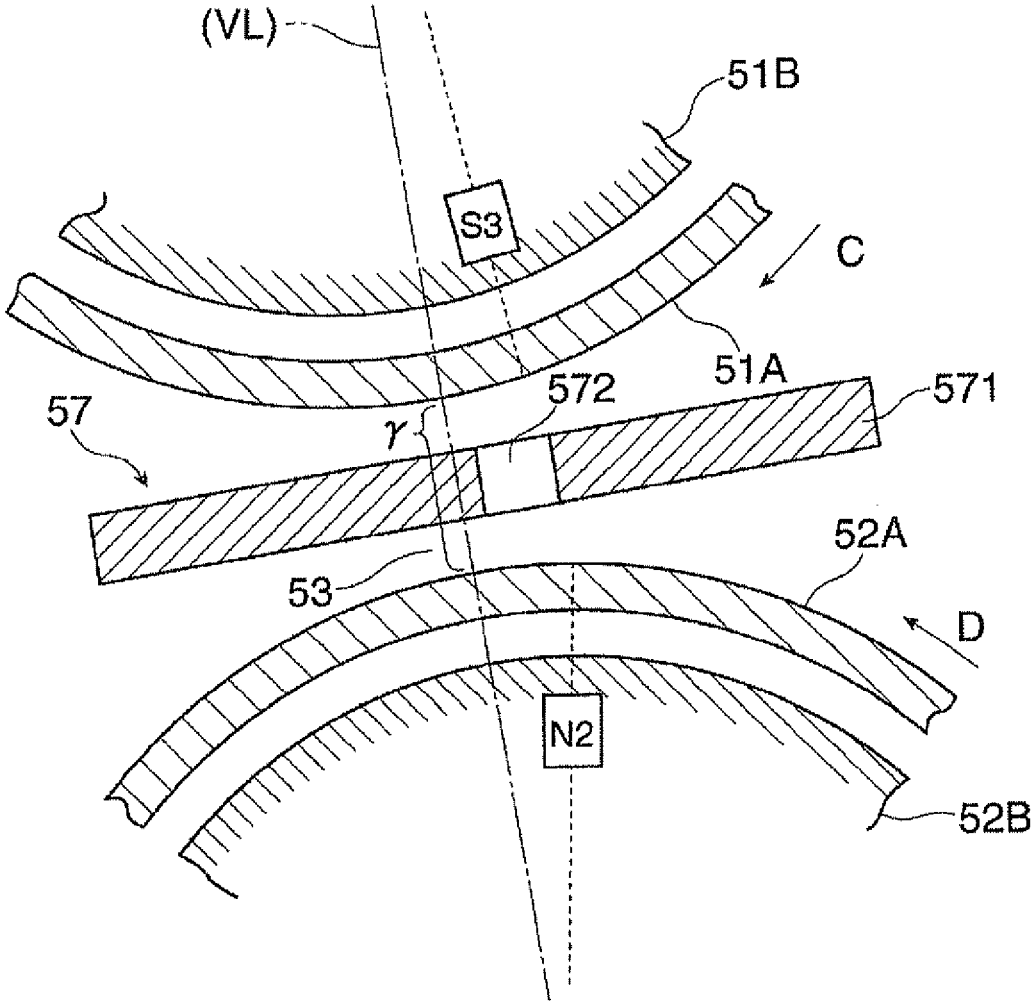
FIG. 6 is an enlarged cross-sectional view illustrating the structure of, for example, a transfer amount regulation plate of the developing device shown in FIG. 3.

In the developing device 5, in order to simply set the amount of developer 8 (division ratio) which is divided and held to the two developing rollers 51 and 52, as shown in FIGS. 4 to 6, the transfer amount regulation plate (slit plate) 57 is provided in the space of the narrowest gap portion 53 between the first developing roller 51 and the second developing roller 52. The transfer amount regulation plate 57 extends along the axial direction J of the developing rollers 51 and 52 in the developer transfer path 8*c* which is formed by a pair of division magnetic poles N2 and S3 with different polarities between the developing rollers 51 and 52 and includes a slit 572 that regulates the amount of developer passing therethrough.

Figure 7A:
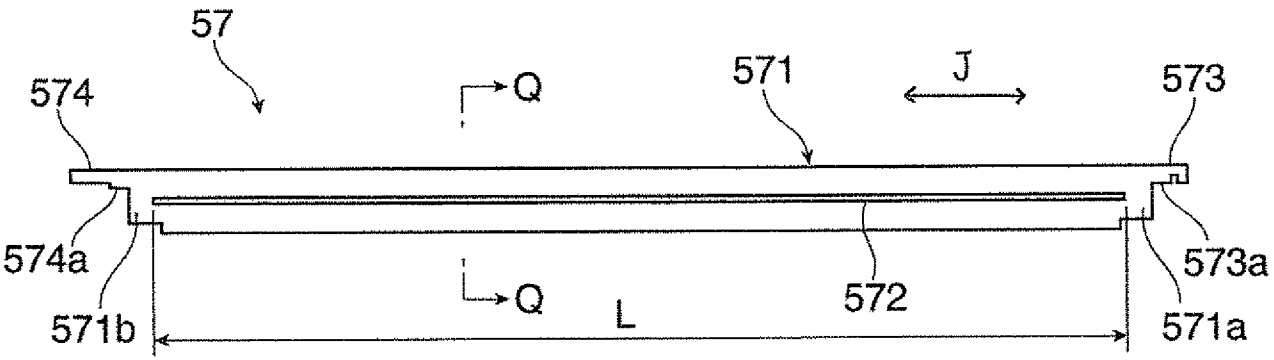
FIG. 7A is a plan view illustrating the transfer amount regulation plate shown in FIG. 4.
Figure 7B:
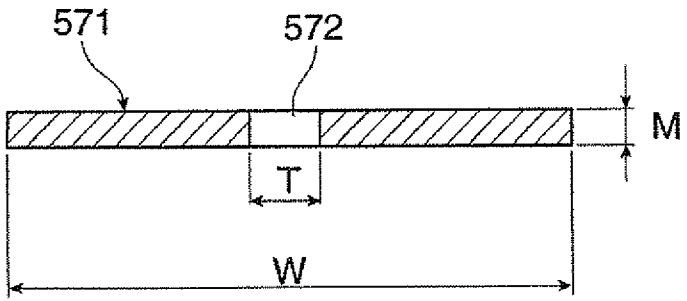
FIG. 7B is a cross-sectional view illustrating the transfer amount regulation plate taken along the line Q-Q of FIG. 7A.

As shown in FIG. 7, the transfer amount regulation plate mainly includes a plate-shaped base 571 that has a substantially long rectangular shape as a whole and the slit 572 that is provided substantially at the center of the plate-shaped base 571 so as to extend in a straight line along the longitudinal direction.

The plate-shaped base 571 is, for example, a flat plate which is made of a non-magnetic material, such as stainless steel (for example, SUS304), and has a thickness M and includes mounting ends 573 and 574 formed at both ends in the longitudinal direction. The width W of the plate-shaped base 571 in a direction substantially perpendicular to the longitudinal direction is, for example, more than the width of the transfer path (8*c*) of the developer 8 formed between the first developing roller 51 and the second developing roller 52 and is set so as not to hinder other functions of the developing device. In addition, the thickness M of the plate-shaped base 571 is less than the gap γ (for example, 4 mm) between the two developing rollers 51 and 52 and is set to so as not to hinder the developers 8*b*, 8*d*, and 8*e* being held and transported by the developing rollers 51 and 52.

The slit 572 has, as a whole, a long rectangular shape which has a predetermined width T and extends in a straight line along the longitudinal direction of the plate-shaped base 571. The length L of the slit 572 in the longitudinal direction is equal to or more than that of the effective developing region of each of the two developing rollers 51 and 52. The width T of the slit 572 is a factor that regulates the passage of the developer in the developer transfer path and determines the actual amount of developer transferred and is set depending on the amount (transfer amount) of developer passing through the slit 572.

As shown in FIG. 6, the transfer amount regulation plate is arranged such that the plate-shaped base 571 is substantially vertical to the virtual line VL connecting the central points G1 and G2 of the two developing rollers 51 and 52 and the slit 572 is disposed in the developer transfer path formed between the developing rollers 51 and 52. The developer transfer path is disposed in, for example, the range in which there are magnetic field lines capable of forming a magnetic brush between the division magnetic poles N2 and S3. In other words, the developer transfer path is disposed in the range between the upstream side and the downstream side of the developing roller 51 in the rotational direction D, with the virtual line VL connecting the central points G1 and G2 of the two developing rollers 51 and 52 interposed between, or the range from a position where straight lines passing through the division magnetic poles N2 and S3 from the central points G1 and G2 of the developing rollers 51 and 52 intersect each other in the narrowest gap portion 53 to the downstream side of the developing roller 51 in the rotational direction D. The developer transfer path is formed even for the period in which the rotation of the developing rollers 51 and 52 is stopped.

When the transfer amount regulation plate 57 is arranged in the above-mentioned state, the attachment structure of the developing device 5 is not particularly limited. However, the developing device 5 according to the first exemplary embodiment uses a supporting structure in which the relative position between the rollers is likely to be changed as the supporting structure of the two developing rollers 51 and 52, which will be described below. Therefore, the following attachment structure is used so as to response to the supporting structure.

First, the supporting structure of the developing rollers 51 and 52 will be described with reference to FIGS. 8 to 12.

First, in the developing rollers 51 and 52, tracking rollers (gap maintaining wheels) 61A to 61D that have dimensions (radius) more than those of the outer circumferential surface of each of the sleeves 51A and 52A by the gap α or β are attached to shafts 51*c*, 51*d*, 52*c*, and 52*d* provided at both ends of the sleeves 51A and 52A. The tracking rollers 61A to 61D are supported so as to be rotated while being pressed against the ends (flanges) 21*b* and 21*c* of the outer circumferential surface of the photosensitive drum 21 (see FIGS. 8 to 11). In this way, as shown in FIG. 4, the developing rollers 51 and 52 (sleeves 51A and 52A) are rotated while maintaining predetermined gaps a and J3 from the photosensitive drum 21.

The developing rollers 51 and 52 have the following supporting structure such that all of the tracking rollers 61A to 61D stably and reliably come into contact with the ends 21*b* and 21*c* of the outer circumferential surface of the photosensitive drum 21.

Figure 8:
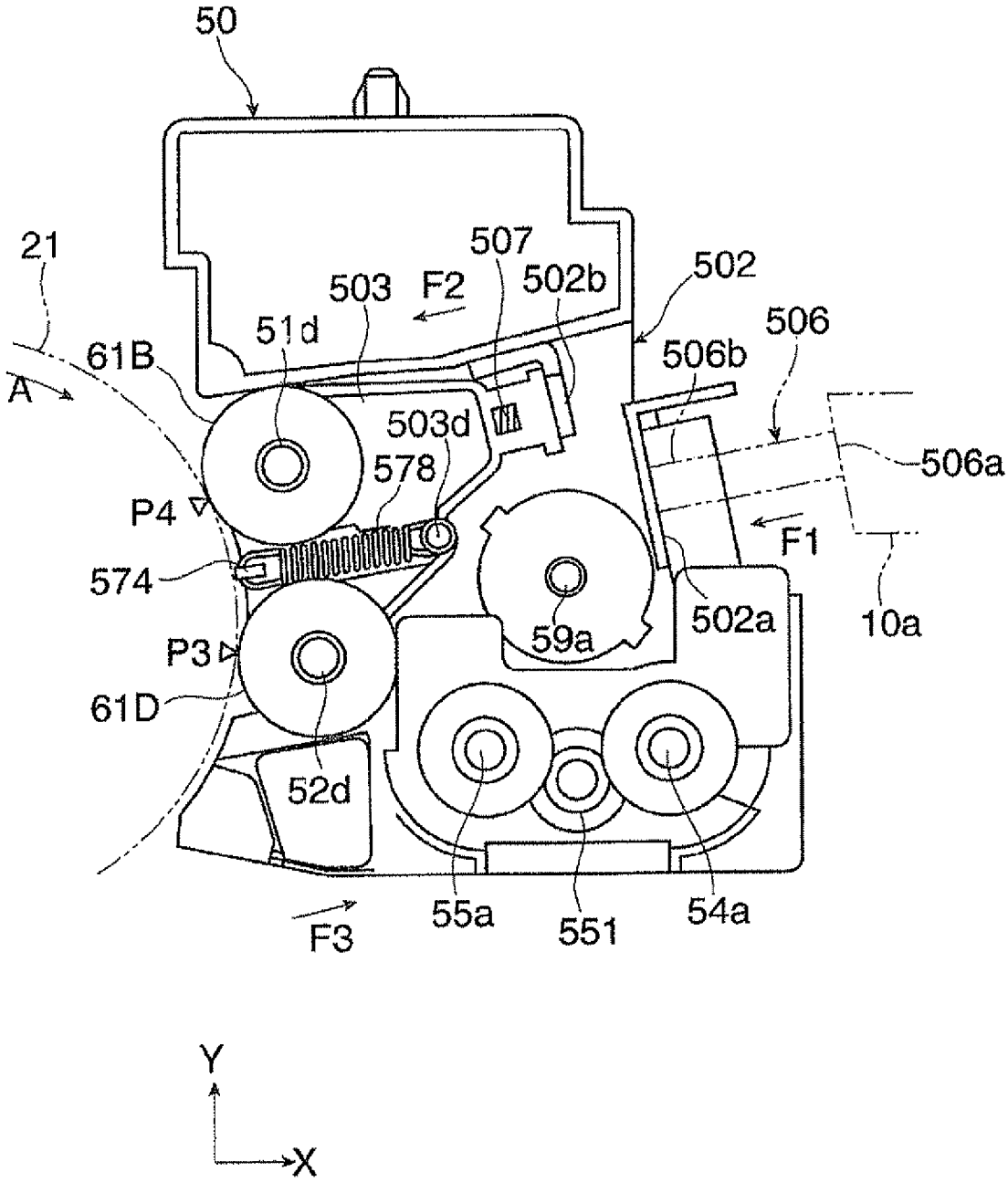
FIG. 8 is an internal diagram illustrating the front side of an attachment structure of developing rollers and the transfer amount regulation plate in the developing device shown in FIG. 3.
Figure 9:
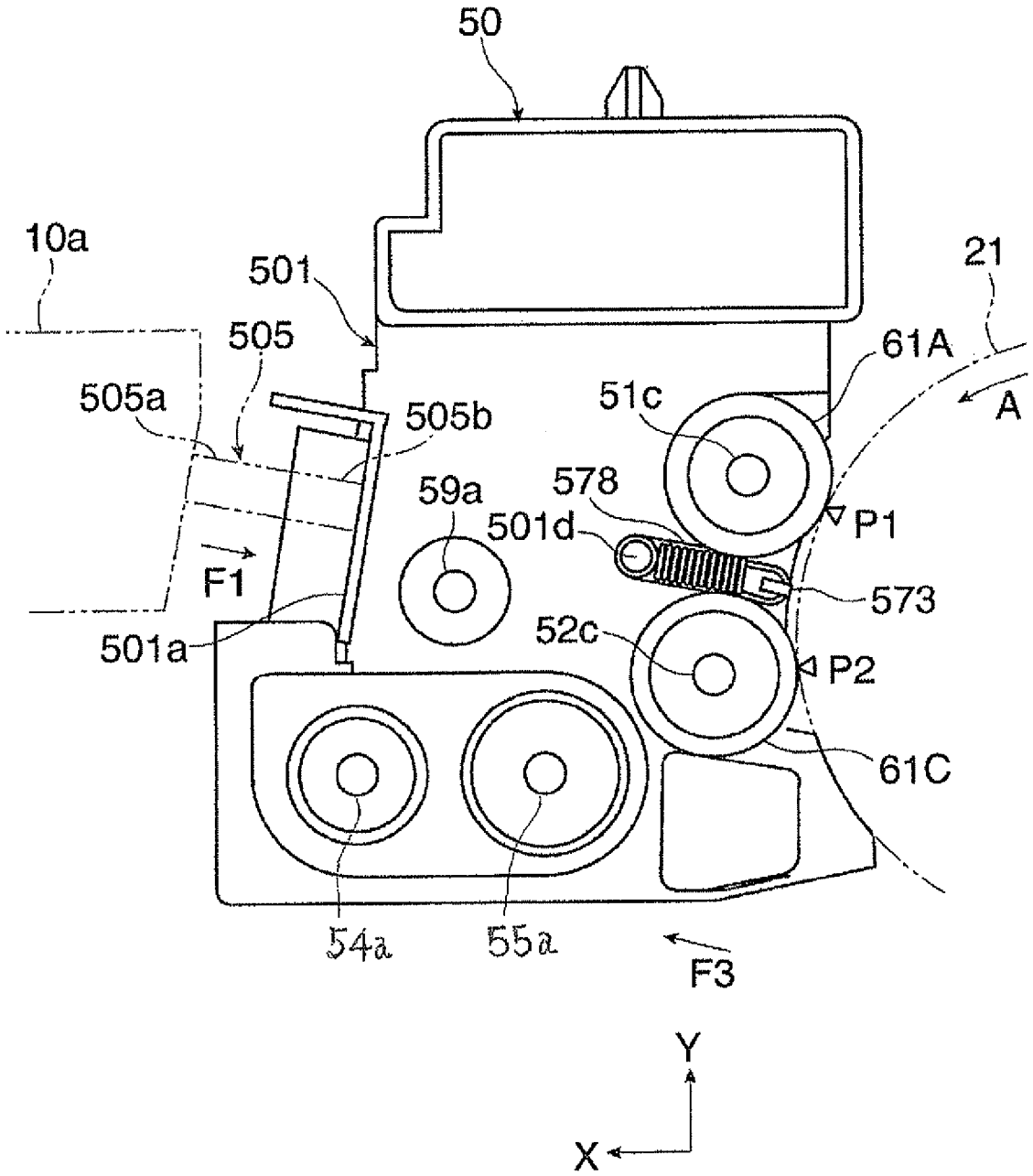
FIG. 9 is an internal diagram illustrating the rear side of the attachment structure of the developing rollers and the transfer amount regulation plate in the developing device shown in FIG. 3.
Figure 10:
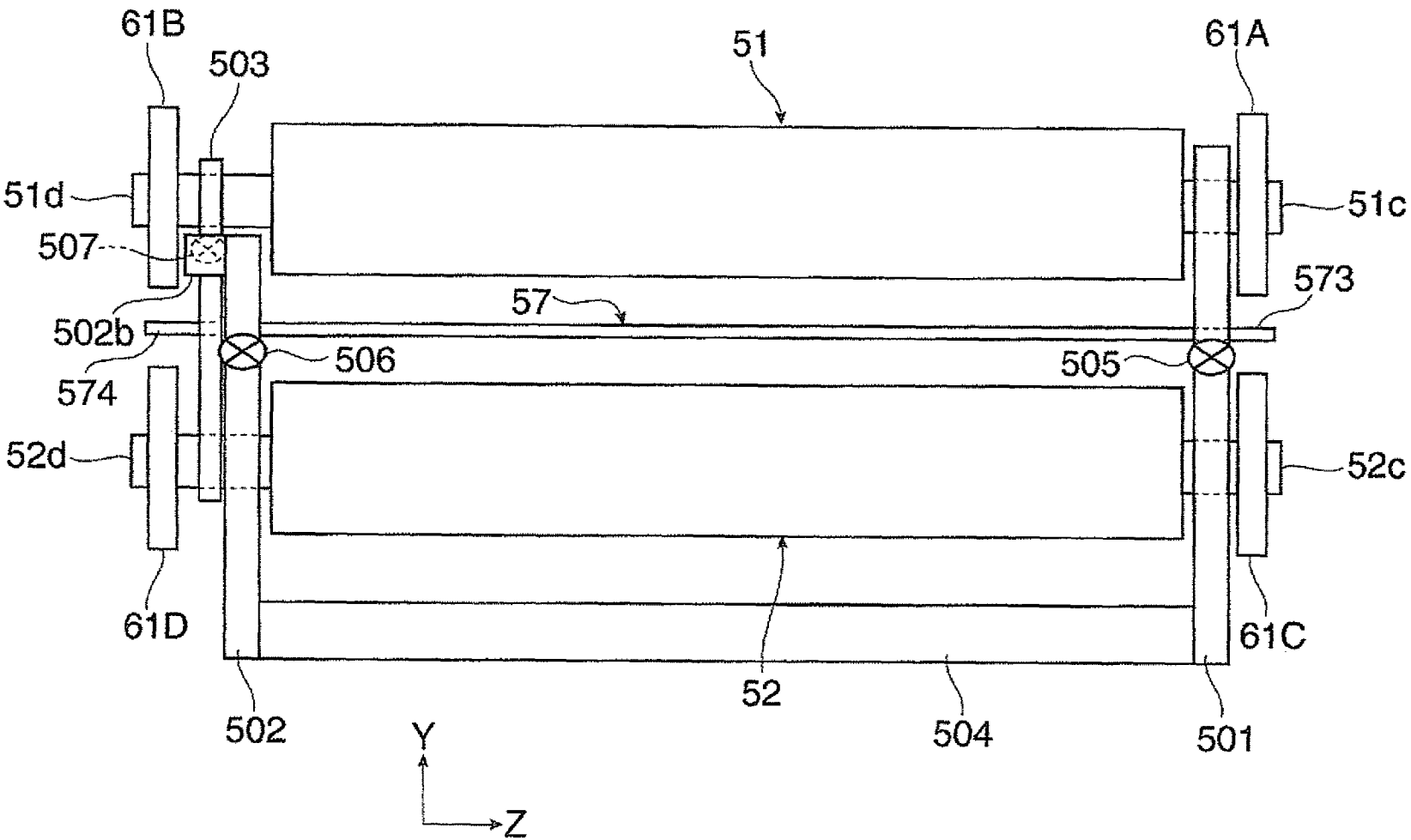
FIG. 10 is a schematic side view illustrating one side of the attachment structure of the developing rollers and the transfer amount regulation plate in the developing device shown in FIG. 3.
Figure 11:
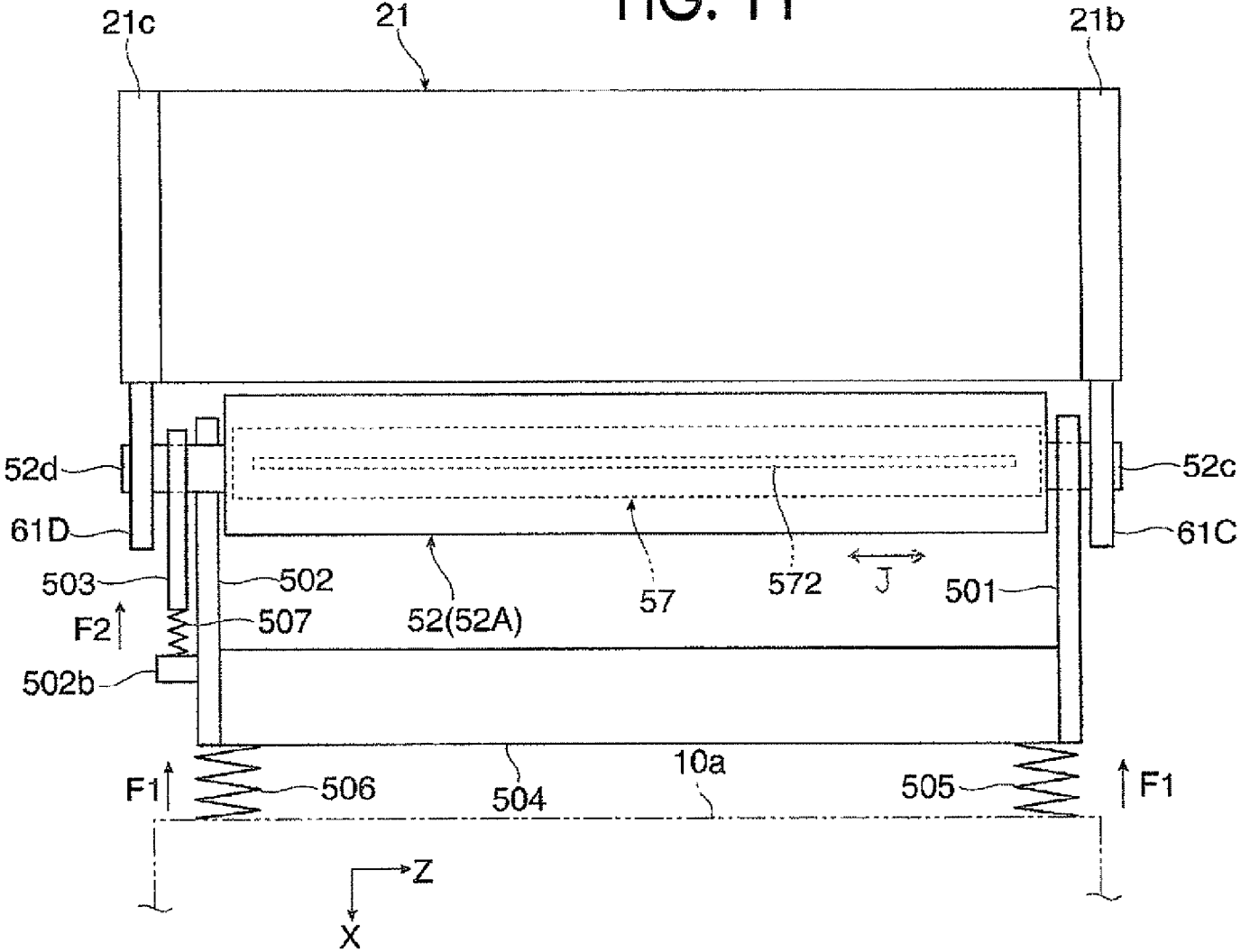
FIG. 11 is a schematic plan view illustrating a portion of the attachment structure of the developing rollers and the transfer amount regulation plate in the developing device shown in FIG. 3.
Figure 12:
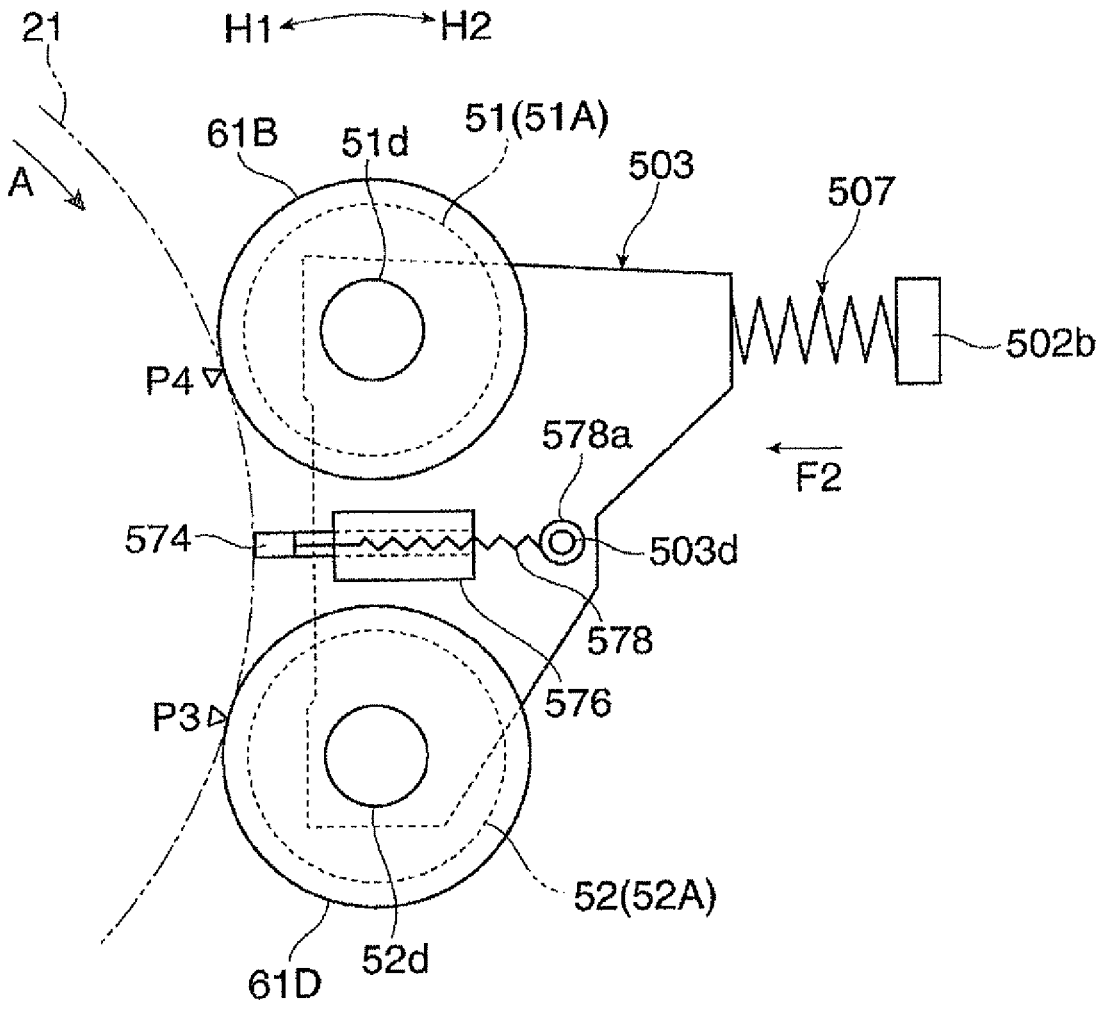
FIG. 12 is a schematic diagram illustrating an attachment structure of the developing rollers and the transfer amount regulation plate to a swing supporting frame in the developing device shown in FIG. 3.

That is, in each of the developing rollers 51 and 52, one end (shaft) 51*c* or 52*c* (for example, the back side of the apparatus: In side) is rotatably attached and supported by a first supporting frame 501 of the housing 50 (see FIGS. 9 and 10). In the second developing roller 52, the other end (shaft) 52*d* (for example, the front side of the apparatus: Out side) is rotatably attached and supported by a second supporting frame 502 of the housing 50 (see FIGS. 8 and 10). In the first developing roller 51, the other end (shaft) 51*d* is rotatably attached and supported by a swing supporting frame 503 that is attached to the shaft 52*d* of the developing roller 52 supported by the second supporting frame 502 and swings on the shaft 52*d* in directions H1 and H2 in which it approaches and is separated from the photosensitive drum 21 (see FIG. 8 and FIGS. 10 to 12). In FIGS. 10 and 11, reference numeral 504 indicates a connection supporting frame that connects the first supporting frame 501 and the second supporting frame 502. In FIGS. 8 and 9, reference numeral 59*a* indicates a shaft of the storage paddle 59. In FIG. 8, reference numeral 551 indicates a connection gear that is engaged with each gear of the screw augers 54 and 55 and is connected thereto.

Pressing mechanisms 505 and 506 elastically press the first supporting frame 501 and the second supporting frame 502 against the photosensitive drum 21 with predetermined pressing force F1 in the direction H1 in which the frames approach the photosensitive drum 21. The first supporting frame 501 and the second supporting frame 502 are attached to a supporting frame (not shown) that supports the photosensitive drum 21 so as to swing in a direction in which it approaches and is separated from the supporting frame. In the attached state, the first supporting frame 501 and the second supporting frame 502 are pressed by the pressing mechanisms 505 and 506. The pressing mechanisms 505 and 506 are, for example, pressing springs. One end 505*a* or 506*a*, which is a fixed end of the spring, is attached to a fixing portion (for example, a portion 10*a* of the housing 10) of the image forming device 20 (or the image forming apparatus 1) and the ends 505*b* and 506*b*, which are free ends, are attached so as to come into contact with pressing surfaces 501*a* and 502*a* of the first supporting frame 501 and the second supporting frame 502, respectively. In addition, a pressing mechanism 507 presses a swing frame 103 with predetermined pressing force F2 in the direction H1 in which the swing frame approaches the photosensitive drum 21. The pressing mechanism 507 is, for example, a pressing spring. One end 507*a*, which is a fixed end of the spring, is attached to a fixing and attaching portion 502*b* of the second supporting frame 502 and the other end 507*b*, which is a free end, is attached to a pressing portion 503*a* of the swing supporting frame 503 while contacting the pressing portion 503*a*.

According to this supporting structure, since the pressing mechanisms 505 and 506 press the first supporting frame 501 and the second supporting frame 502 with the predetermined pressing force F1 in the direction H1 in which the frames approach the photosensitive drum 21, one tracking roller 61A of the first developing roller 51 and two tracking rollers 61C and 61D of the second developing roller 52 are maintained while reliably coming into contact with the ends 21*b* and 21*c* of the outer circumferential surface of the photosensitive drum 21 at a total of three points (P1, P2, and P3). In addition, since the pressing mechanism 507 presses the swing supporting frame 503 with the predetermined pressing force F2 in the direction H1 in which the swing frame approaches the photosensitive drum 21 in the second supporting frame 502, the other tracking roller 61B of the first developing roller 51 is maintained while reliably coming into contact with the end 21*c* of the outer circumferential surface of the photosensitive drum 21 at one point (P4).

As a result, among the four tracking rollers 61A to 61D, three tracking rollers 61A to 61C come into contact with the photosensitive drum 21 at three points and one tracking roller 61D reliably comes into contact with the photosensitive drum 21 at one point. As a whole, all of the four tracking rollers 61A to 61D are maintained while stably and reliably coming into contact with the photosensitive drum 21. That is, in the supporting structure in which both ends of each of the two developing rollers 51 and 52 are attached to a pair of supporting frames with a gap γ therebetween and the supporting frames are pressed by the pressing mechanism in the direction in which they approach the photosensitive drum, in some cases, one of the four tracking rollers is not likely to come into good contact with the photosensitive drum. However, the problem does not occur. In addition, in the supporting structure, since one end 51*d* of the first developing roller 51 is supported by a movable frame different from the frames supporting the ends of the other developing rollers, the relative position between the developing rollers 51 and 52 is likely to be changed.

Next, since the supporting structure of the developing rollers 51 and 52 is used, the mounting end 573 formed at one end of the transfer amount regulation plate 57 is attached to the first supporting frame 501 and the mounting end 574 formed at the other end is attached to the swing supporting frame 503, as shown in FIGS. 8 to 13.

Figure 13:
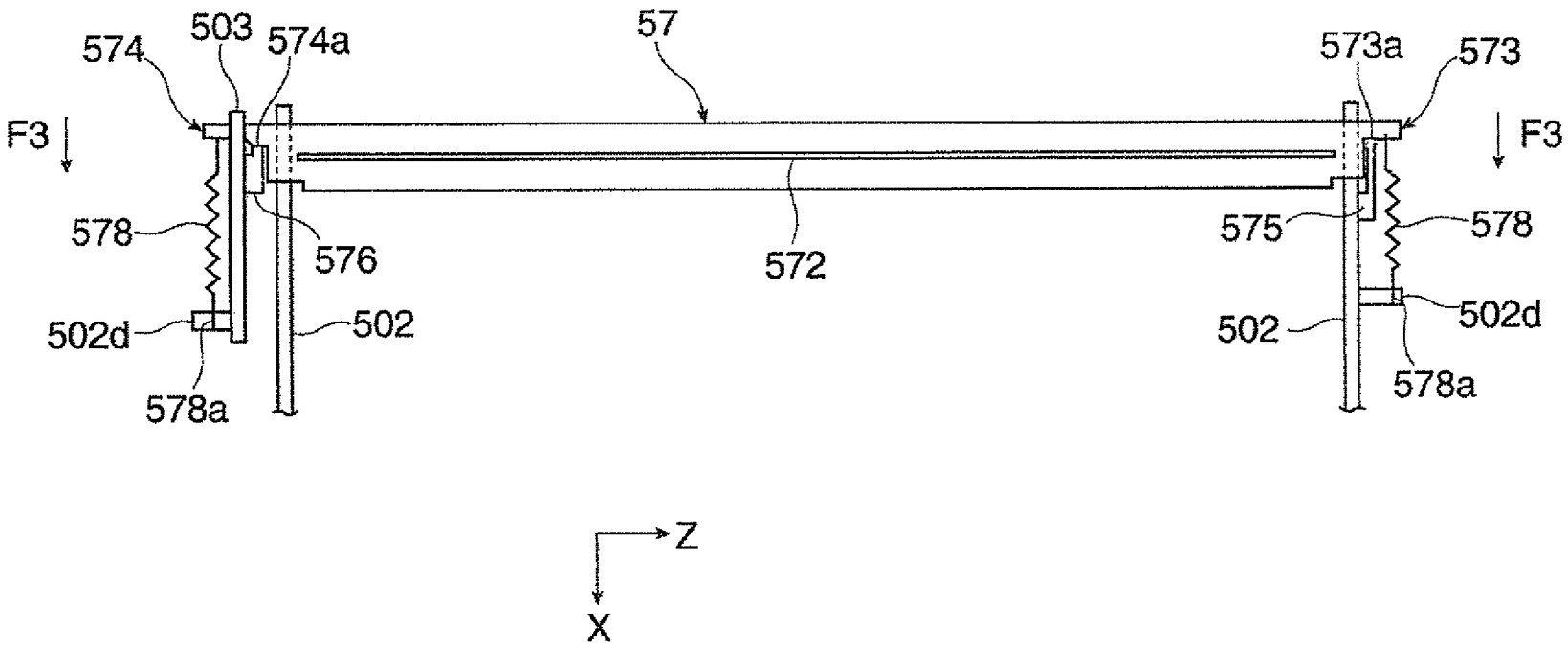
FIG. 13 is a schematic plan view illustrating the attachment structure of the transfer amount regulation plate in the developing device shown in FIG. 3.

Specifically, as shown in FIG. 13, in the transfer amount regulation plate 57, one end 571*a* of the plate-shaped base 571 is inserted into a concave mounting portion (not shown) provided in the first supporting frame 501 and is supported by the concave mounting portion, and the other end 571*b* of the plate-shaped base 571 is inserted into a concave mounting portion (not shown) provided in the swing supporting frame 503 and is supported by the concave mounting portion. In addition, reference surfaces 573*a* and 574*a* are provided in the mounting ends 573 and 574 provided at both ends of the transfer amount regulation plate 57. The reference surfaces 573*a* and 574*a* come into contact with the positioning surfaces of positioning members 575 and 576 which are provided in the first supporting frame 501 and the swing supporting frame 503, respectively.

The concave mounting portions are formed such that the transfer amount regulation plate 57 is disposed in the space of the narrowest gap portion 53 between the two developing rollers 51 and 52 such that gaps from the two rollers are substantially the same. In addition, at the position regulated by the reference surfaces 573*a* and 574*a* and the positioning members 575 and 576, the slit 572 of the transfer amount regulation plate 57 is disposed in the developer transfer path (8*c*) formed between the developing rollers 51 and 52. However, in practice, the straight slit 572 is parallel to the axial direction J of the first developing roller 51 at the position. The positioning members 575 and 576 are attached to the first supporting frame 501 and the swing supporting frame 503 such that the positions thereof may be finely adjusted (for example, the positions may be changed in the direction in which the concave mounting portion is mounted).

As shown in FIGS. 8, 9, and 13, the mounting ends 573 and 574 formed at both ends of the transfer amount regulation plate 57 are drawn with predetermined tensile force F3 by a tension spring 578 and the contact between the reference surfaces 573*a* and 574*a* and the positioning surfaces of the positioning members 575 and 576 is maintained. The spring 578 includes one end 578*a* which is a fixed end and is attached to attachment portions 502*d* and 503*d* of the frames 502 and 503 and the other end 578*b* which is a free end and is attached to the mounting ends 573 and 574 of the transfer amount regulation plate 57.

In this way, the transfer amount regulation plate 57 is attached such that the slit 572 is disposed in the developer transfer path (8*c*) formed between the developing rollers 51 and 52. In practice, even when the first developing roller 51 is displaced by the swing of the swing supporting frame 503 and the position of the first developing roller 51 relative to the second developing roller 52 is changed, the transfer amount regulation plate 57 is attached such that the slit 572 is parallel to the axial direction J of the first developing roller 51 (see FIGS. 11 and 14). The position of the positioning members 575 and 576 is finely adjusted in order to finely adjust the attachment state of the transfer amount regulation plate 57. For example, even when there is a dimension tolerance or an assembly tolerance in components, such as the two developing rollers 51 and 52, the layer regulation plate 56, and the transfer amount regulation plate 57, it is possible to accurately attach the component at desired positions.

Figure 14:
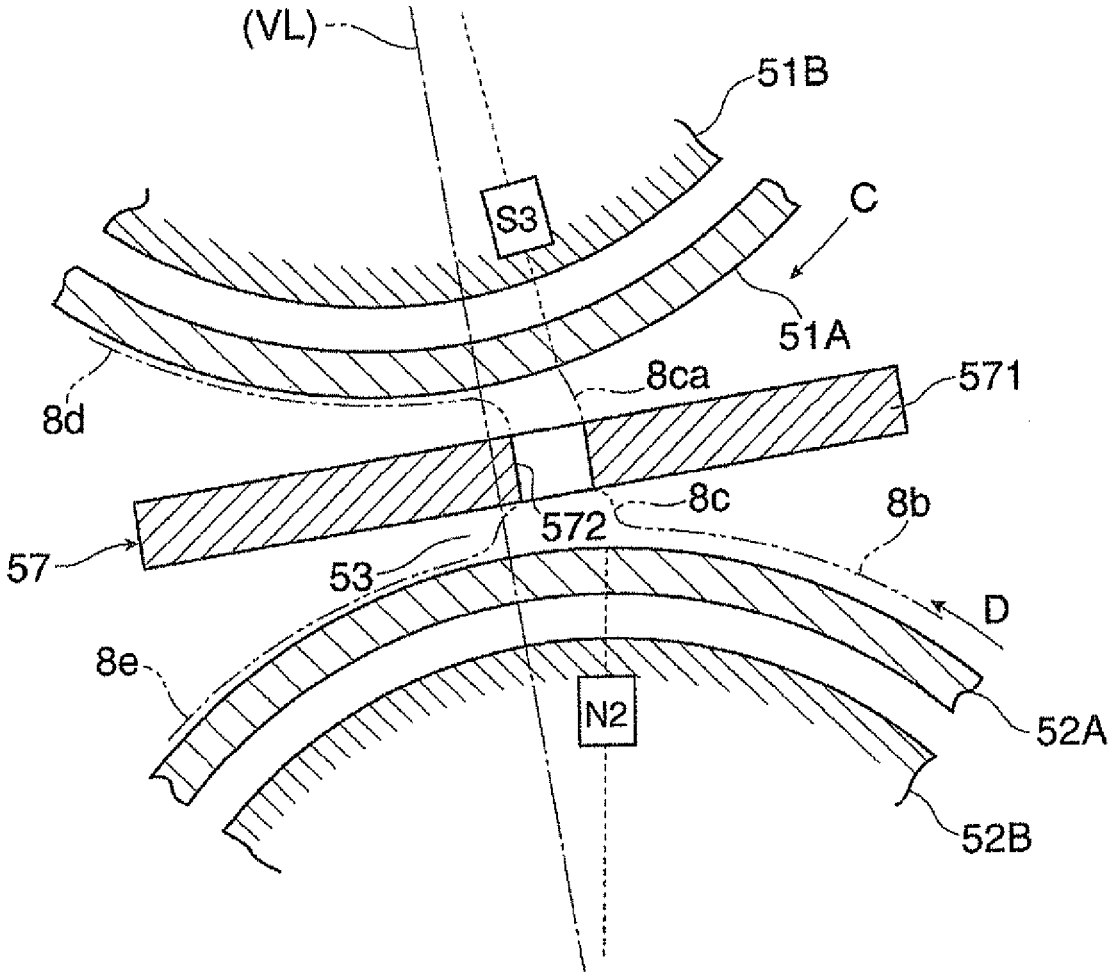
FIG. 14 is an enlarged cross-sectional view illustrating the operation of a transfer path or the transfer amount regulation plate in the developing device shown in FIG. 3.

As shown in FIG. 14, since the developing device 5 includes the transfer amount regulation plate 57, a portion of the developer 8*b* which is transported by the second developing roller 52 while the height of the layer thereof is regulated is transferred to the first developing roller 51 by the developer transfer path 8*c* which is formed by a pair of division magnetic poles N2 and S3 with different polarities between the two developing rollers 51 and 52 immediately before it reaches the narrowest gap portion 53 between the first developing roller 51 and the second developing roller 52. At that time, the amount of developer 8 actually transferred to the first developing roller 51 is regulated to the amount of developer 8 capable of passing through the slit 572 (throughput). As a result, the developers 8*d* and 8*e* which are divided at a predetermined ratio are distributed to the two developing rollers 51 and 52 and are held by the two developing rollers 51 and 52. In FIG. 14, reference numeral 8*ca* indicates a developer which actually passes through the slit 572 of the transfer amount regulation plate 57 among the developers in the developer transfer path 8*c*.

Therefore, in the developing device 5, it is possible to simply set the amount of developer 8 (division ratio) to be distributed and held by the two developing rollers 51 and 52. In addition, the width T (FIG. 7*b*) of the slit 572 is changed to adjust the division ratio of the developer 8 by the transfer amount regulation plate 57.

In the developing device 5, for example, even when the relative position between the first developing roller 51 and the second developing roller 52 is changed, the slit 572 is disposed at a predetermined position in the developer transfer path 8*c* between the two developing rollers 51 and 52 since the both ends of the transfer amount regulation plate 57 and both ends of the first developing roller 51 are attached to the same supporting frames 501 and 503. Therefore, the transfer amount regulation plate 57 stably divides the amount of developer 8 at a desired ratio.

In the developing device 5, it is possible to simply set the amount of developer 8 to be held by the two developing rollers 51 and 52. Therefore, the two developing rollers 51 and 52 stably perform a developing operation with necessary content. As a result, the image forming apparatus 1 including the developing device 5 may form an image with stable quality.

Evaluation Test

Next, an evaluation test using the developing device 5 according to the first exemplary embodiment will be described.

In the evaluation test, as the developing device 5, a developing device having the following structure is prepared and the amounts of developers 8*d* and 8*e* held by the first developing roller 51 and the second developing roller 52 after the developers 8*d* and 8*e* are divided by the transfer amount regulation plate 57 are measured. The amounts of developers are measured at three positions, that is, an IN side (one end), the center, and an Out side (the other end) in the axial direction J of the developing rollers 51 and 52.

The main structure of the developing device 5 is as follows. The first developing roller 51 is used which included a cylindrical sleeve 51A with an outside diameter of 25 mm and a thickness of 1 mm and a magnet roller 51B including a division pole S3 which had a magnetic force (magnetic flux density) of 70 mT and is disposed at the position where the center angle thereof with respect to the virtual line VL is about 10°. The second developing roller 52 is used which included a cylindrical sleeve 52A having the same conditions as the sleeve 51A and a magnet roller 52B including a division pole N2 which had a magnetic force (magnetic flux density) of 70 mT and is disposed at the position where the center angle thereof with respect to the virtual line VL is about 5°. In addition, the first developing roller 51 the second developing roller 52 are arranged with a gap γ of 4 mm therebetween and are rotated in the directions of the arrows C and D in FIG. 4 such that the circumferential speed ratio therebetween is 1.5:1.0.

The transfer amount regulation plate 57 is used which included a plate-shaped base 571 with a width W of 20 mm and a thickness of 1.5 mm and a straight slit 572 which is provided substantially at the center of the plate-shaped base 571 and had a length L of 335 mm in the longitudinal direction of the plate-shaped base 571. In addition, two kinds of transfer amount regulation plates 57 including slits 572 with a width T of 1.0 mm and 1.5 mm are prepared.

As the developer 8, a two-component developer including non-magnetic toner which is made of a non-magnetic resin and had an average particle diameter of 3.8 μm and magnetic carrier particles which are made of a magnetic material and has an average particle diameter of 25 μm is prepared. The developer 8 is held and supplied to the narrowest gap portion 53 between the two developing rollers 51 and 52 such that the amount of developer 8 held by the second developing roller 52 after the developer 8 passed through the layer regulation plate 56 is about 600 g/m$^2$. At that time, the width (the width in the rotational direction of the developing roller 52) of the developer transfer path 8*c* formed in the narrowest gap portion 53 between the developing rollers 51 and 52 is about 2 mm.

Figure 16:
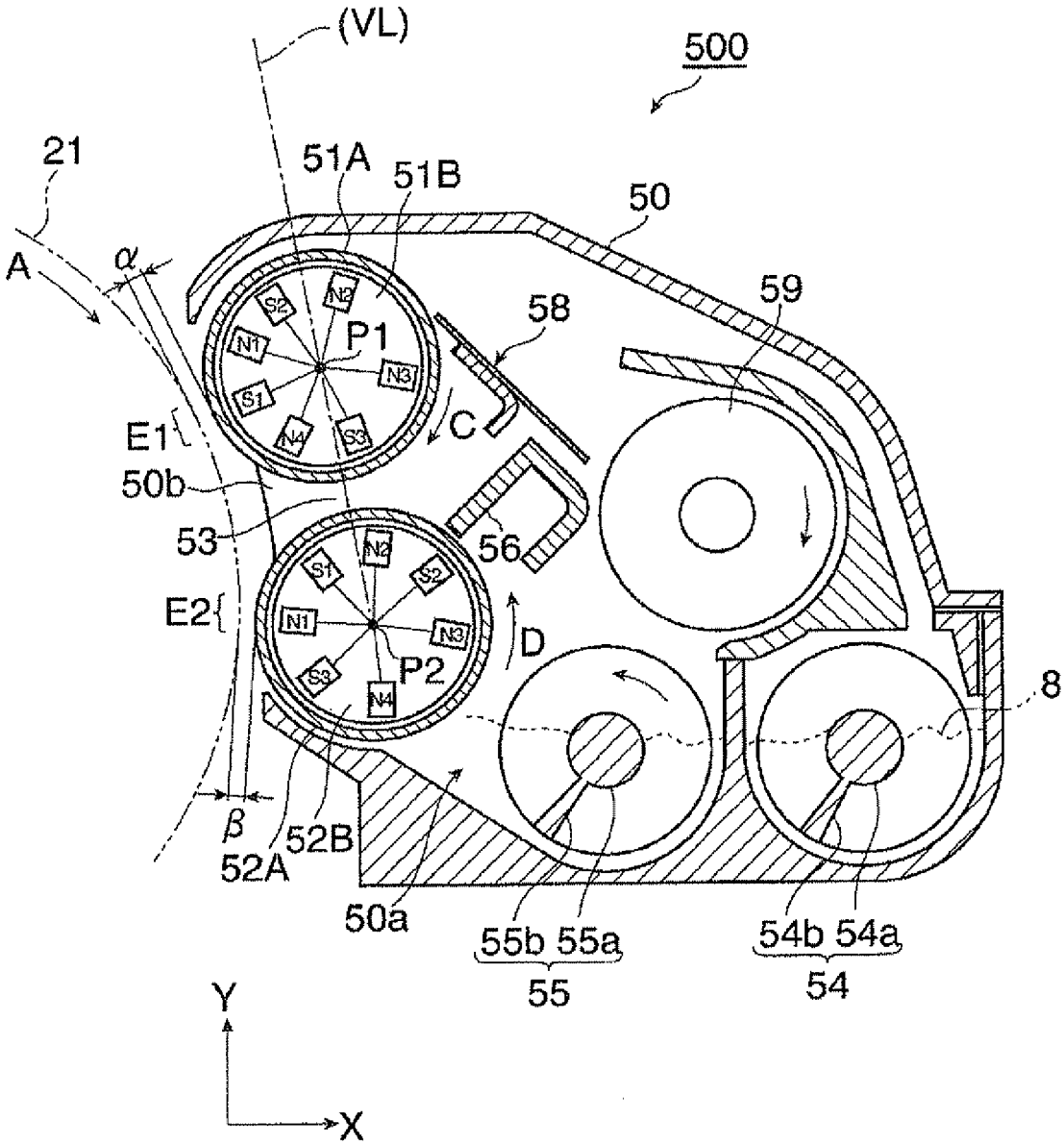
FIG. 16 is a schematic cross-sectional view illustrating a developing device according to a comparative example which is used in the evaluation test.

For comparison, as shown in FIG. 16, a developing device 500 (comparative example) is prepared which differed from the developing device 5 in that the transfer amount regulation plate (slit plate) 57 is omitted and is not prepared, and the same evaluation test as described above is performed for the developing device 500.

Figure 15A:
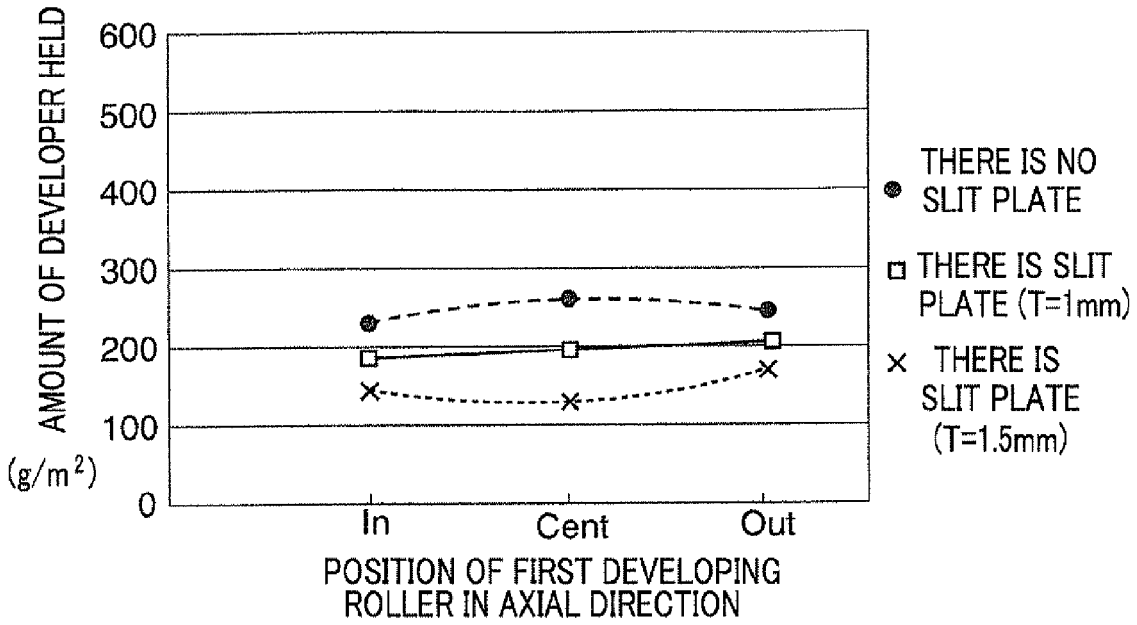
FIGS. 15A and 15B are graphs illustrating the result of an evaluation test.
Figure 15B:
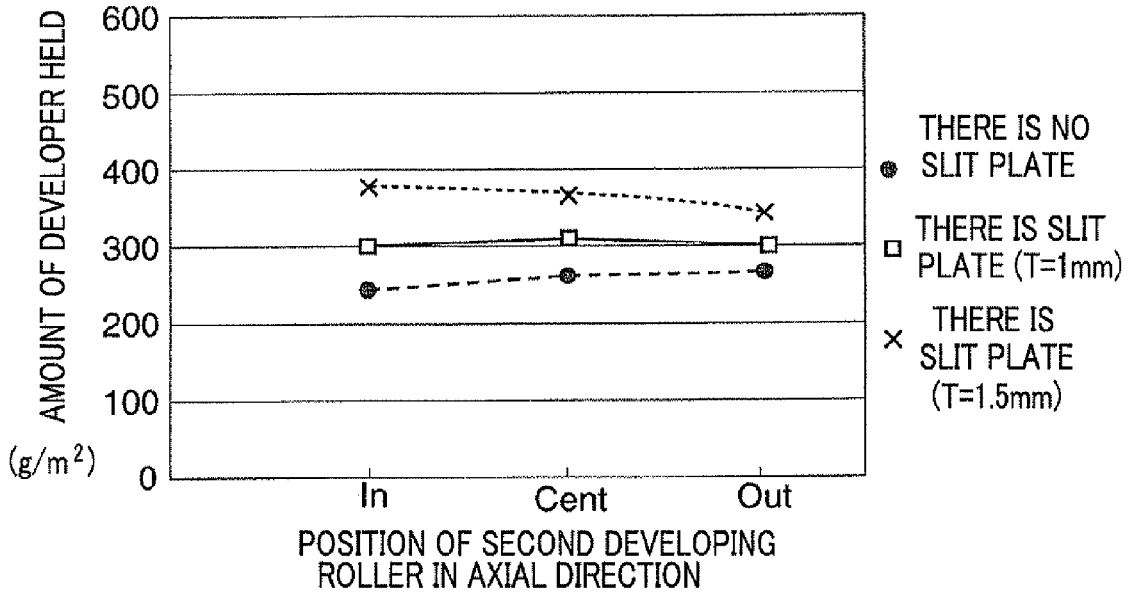

The measurement result in this case is shown in FIG. 15. As can be seen from the result shown in FIG. 15, the use of the transfer amount regulation plate 57 makes it possible to simply set the amount (division ratio) of developer 8 held by the two developing rollers 51 and 52 after division. That is, when the transfer amount regulation plate 57 including the slit 572 with a width T of 1.0 mm is used, it is possible to divide the developer at a ratio of about 2:3 with respect to the first developing roller 51 and the second developing roller 52. When the transfer amount regulation plate 57 including the slit 572 with a width T of 1.5 mm is used, it is possible to divide the developer at a ratio of about 1.5:3.5 with respect to the first developing roller 51 and the second developing roller 52.

In contrast, in the case of the developing device 500 without the transfer amount regulation plate 57, it is possible to divide the developer at a ratio of about 2.5:2.5 (substantially the same ratio) with respect to the first developing roller 51 and the second developing roller 52. In addition, in the developing device 500, in order to change and set the amount (division ratio) of developer 8 divided and held by the developing rollers 51 and 52, for example, the magnetic force or arrangement position of the division poles N2 and S3 may be changed or the gap γ between the developing rollers 51 and 52 may be changed. However, in this case, a structure for responding to the change in setting becomes complicated and it is difficult to simply change the setting.

Other Exemplary Embodiments

In the first exemplary embodiment, in the transfer amount regulation plate 57 of the developing device 5, the straight slit 572 is provided in the plate-shaped base 571. However, the structure of the transfer amount regulation plate 57 may be changed as long as it may adjust (regulate) the division ratio of the developer in the developer transfer path.

In the first exemplary embodiment, the developing device 5 has the supporting structure in which two supporting frames 501 and 502 and one swing supporting frame 503 separately support two developing rollers 51 and 52. However, a structure in which only two supporting frames 501 and 502 support two developing rollers 51 and 52 may be used. In this case, for example, a structure may be used in which both ends of the transfer amount regulation plate 57 are attached to the two supporting frames 501 and 502 (such that the position may be changed) and are supported by the two supporting frames 501 and 502. The pressing mechanisms 505, 506, and 578 may have other structures.

In the first exemplary embodiment, in the two developing rollers 51 and 52 of the developing device 5, the division poles N2 and S3 are disposed at the position deviating from the virtual line VL in a direction in which it is separated from the photosensitive drum 21. However, in the developing rollers 51 and 52, the division poles N2 and S3 may be arranged on the virtual line VL. In addition, the number of magnetic poles and the arrangement positions thereof in the magnet rollers 51B and 52*b* of the two developing rollers 51 and 52 are not limited to the above, and another configuration may be available. The developing device may not include, for example, the storage paddle 59, or it may use a mono-component developer with magnetism as the developer.

The image forming apparatus 1 using the developing device 5 according to the exemplary embodiment of the invention may have any structure, for example, any type as long as it may use the developing device 5. An image forming apparatus may have the structure according to the related art. For example, an image forming apparatus using a photosensitive belt instead of the photosensitive drum 21 may be used. In addition, the image forming apparatus 1 may include only one developing device 5.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a first developing roller that has a cylindrical shape, is arranged with a predetermined gap from an outer circumferential surface of a rotating latent image holder, is rotated so that a moving direction of a portion approaching the latent image holder is opposite to that of the latent image holder, and holds and transports a developer with magnetic force;

a second developing roller that has a cylindrical shape, is provided on a downstream side of the first developing roller in a rotational direction of the latent image holder, with a predetermined gap from the outer circumferential surface of the latent image holder and the first developing roller, is rotated so that a moving direction of a portion approaching the latent image holder is the same as that of the latent image holder, and holds and transports the developer with the magnetic force;

a layer regulation member that is arranged with a predetermined gap from the second developing roller and regulates the height of a layer of the developer which is supplied and held by the outer circumferential surface of the second developing roller;

a pair of division magnetic poles that have different polarities, are arranged in adjacent regions between the first and second developing rollers in an internal space of the first developing roller and an internal space of the second developing roller so as to face each other, without being rotated, divide the developer which is held by the second developing roller after passing through the layer regulation member, and transfer the developer to the first developing roller;

a transfer amount regulation member that has a plate shape, is provided in a developer transfer path formed by the pair of division magnetic poles between the first developing roller and the second developing roller so as to extend in an axial direction of the first and second developing rollers, and is provided with a slit which regulates the amount of developer passing therethrough;

a first fixed supporting body to which one end of each of the first developing roller and the second developing roller is attached and supported;

a second fixed supporting body to which the other end of the first developing roller or the second developing roller is attached and supported;

a swing supporting body to which the other end of the developing roller which is not supported by the second fixed supporting body is attached and supported and which is mounted to a shaft of the developing roller supported by the second fixed supporting body and swings on the shaft in a direction in which the swing supporting body approaches and is separated from the latent image holder; and a pressing mechanism that is attached to the second fixed supporting body and presses the swing supporting body in a direction in which the swing supporting body approaches the latent image holder, wherein the transfer amount regulation member includes one end which is attached to the first fixed supporting body and the other end which is attached to the swing supporting body.

2. The developing device according to claim 1, wherein the slit of the transfer amount regulation member has a predetermined width and extends in a straight line along the axial direction of the first and second developing rollers.

3. The developing device according to claim 2, wherein the width of the slit of the transfer amount regulation member is changed to adjust the amount of developer passing therethrough.

4. The developing device according to claim 1, wherein the transfer amount regulation member is supported so that the position of both ends thereof is adjustable.

5. The developing device according to claim 2, wherein the transfer amount regulation member is supported so that the position of both ends thereof is adjustable.

6. The developing device according to claim 3, wherein the transfer amount regulation member is supported so that the position of both ends thereof is adjustable.

7. An image forming apparatus comprising:

a rotating latent image holder; and the developing device according to claim 1 that supplies a developer to the latent image holder to develop a latent image.

8. An image forming apparatus comprising:

a rotating latent image holder; and the developing device according to claim 2 that supplies a developer to the latent image holder to develop a latent image.

* * * * *